US012560168B2

(12) United States Patent
Naganuma

(10) Patent No.: US 12,560,168 B2
(45) Date of Patent: Feb. 24, 2026

(54) VARIABLE DISPLACEMENT PUMP

(71) Applicant: HITACHI ASTEMO, LTD., Hitachinaka (JP)

(72) Inventor: Atsushi Naganuma, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 618 days.

(21) Appl. No.: 17/641,530

(22) PCT Filed: Sep. 3, 2020

(86) PCT No.: PCT/JP2020/033450
§ 371 (c)(1),
(2) Date: Mar. 9, 2022

(87) PCT Pub. No.: WO2021/054137
PCT Pub. Date: Mar. 25, 2021

(65) Prior Publication Data

US 2022/0316473 A1 Oct. 6, 2022

(30) Foreign Application Priority Data

Sep. 18, 2019 (JP) ..... 2019-169664

(51) Int. Cl.
*F04C 14/22* (2006.01)
*F04C 14/24* (2006.01)

(52) U.S. Cl.
CPC ..... *F04C 14/226* (2013.01); *F04C 14/24* (2013.01); *F04C 2210/206* (2013.01)

(58) Field of Classification Search
CPC ..... F04C 2/344; F04C 14/226; F04C 14/24; F04C 2210/206
(Continued)

(56) References Cited

U.S. PATENT DOCUMENTS

2016/0153325 A1* 6/2016 Saga ..... F01M 1/16 418/24
2017/0276132 A1* 9/2017 Muramatsu ..... F04C 15/06
(Continued)

FOREIGN PATENT DOCUMENTS

JP 2012-122389 A 6/2012
JP 2013-057326 A 3/2013
(Continued)

OTHER PUBLICATIONS

International Preliminary Report on Patentability dated Mar. 15, 2022 issued in International Application No. PCT/JP2020/033450, with English translation, 12 pages.
(Continued)

*Primary Examiner* — Philip E Stimpert
(74) *Attorney, Agent, or Firm* — FOLEY & LARDNER LLP

(57) ABSTRACT

Discharge port (26) as arc-recessed discharge portion is formed by cutting on bottom surface (13*a*) of pump accommodating portion (13) of variable displacement pump. On mounting surface (1*b*) of housing body (1), first low pressure chamber (281) is formed at position overlapping with discharge port (26) in radial direction of pump structure (14) formed by driving shaft (3), rotor (4) and vanes (5) Drain hole (28*b*) communicating with low pressure portion located outside housing body (1) is formed on bottom surface (28*a*) of first low pressure chamber (281) along direction of rotation axis (O1) of pump structure (14). Low pressure portion has pressure that is hydraulic pressure of oil discharged from discharge port (26) or less. Oil from discharge port (26), having higher pressure than first low pressure chamber (281), flows into first low pressure chamber (281) by pressure difference between discharge port (26) and first low pressure chamber (281).

2 Claims, 16 Drawing Sheets

(58) Field of Classification Search
USPC ..... 417/218, 219, 220, 212, 410.3, 410.4
See application file for complete search history.

(56) References Cited

U.S. PATENT DOCUMENTS

| | | | | |
|---|---|---|---|---|
| 2018/0258930 | A1* | 9/2018 | Naganuma | F04C 2/3441 |
| 2018/0266287 | A1 | 9/2018 | Okazawa et al. | |

FOREIGN PATENT DOCUMENTS

| | | | | |
|---|---|---|---|---|
| JP | 2015-161249 | A | 9/2015 | |
| JP | 2016-098767 | A | 5/2016 | |
| JP | 2018-155141 | A | 10/2018 | |
| WO | WO-2019170216 | A1 * | 9/2019 | F04C 14/223 |

OTHER PUBLICATIONS

International Search Report dated Oct. 20, 2020 issued in International Application No. PCT/JP2020/033450, with English translation, 5 pages.
Notice of Reasons for Refusal dated Mar. 14, 2023 issued in Japanese Patent Application No. 2021-546594, with English translation, 12 pages.

* cited by examiner

VARIABLE DISPLACEMENT PUMP

TECHNICAL FIELD

The present invention relates to a variable displacement pump.

BACKGROUND ART

As a variable displacement pump, for instance, a variable displacement pump described in the following Patent Document 1 is known.

In the variable displacement pump of the Patent Document 1, an adjustment ring for changing pressure of oil discharged from the pump is accommodated in a pump housing, and a discharge portion is provided at an inner side of this adjustment ring. Further, a control hydraulic chamber for forcing the adjustment ring by introducing oil into the control hydraulic chamber is provided at an opposite side to the discharge portion with respect to the adjustment ring. Introduction and discharge of the oil into and from this control hydraulic chamber are performed through a control valve.

CITATION LIST

Patent Document

Patent Document 1: Japanese Unexamined Patent Application Publication No. 2018-155141

SUMMARY OF THE INVENTION

Technical Problem

In the case of the variable displacement pump of the Patent Document 1, when the oil discharged from the discharge portion flows into the control hydraulic chamber through a side clearance(s) between the pump housing and the adjustment ring, oil pressure in the control hydraulic chamber becomes high, then the adjustment ring moves. As a consequence, there is a risk that supply of desired oil into an internal combustion engine will be suppressed.

The present invention was made in view of the above conventional circumstances. An object of the present invention is therefore to provide a variable displacement pump that is capable of supplying the desired oil into the internal combustion engine.

Solution to Problem

As one of preferable aspects of the present invention, a variable displacement pump has a first low pressure chamber provided at a position that overlaps with a discharge portion between a pump accommodating portion and an adjustment ring in a radial direction of a pump structure with respect to a rotation axis of the pump structure, and the first low pressure chamber communicates with a low pressure portion that has pressure that is equal to or less than a hydraulic pressure of the oil discharged from the discharge portion.

Effects of Invention

According to the present invention, it is possible to supply the desired oil into the internal combustion engine.

EMBODIMENTS FOR CARRYING OUT THE INVENTION

Embodiments of a variable displacement pump according to the present invention will be described below with reference to the drawings.

First Embodiment (Configuration of Variable Displacement Pump)

Figure 1:
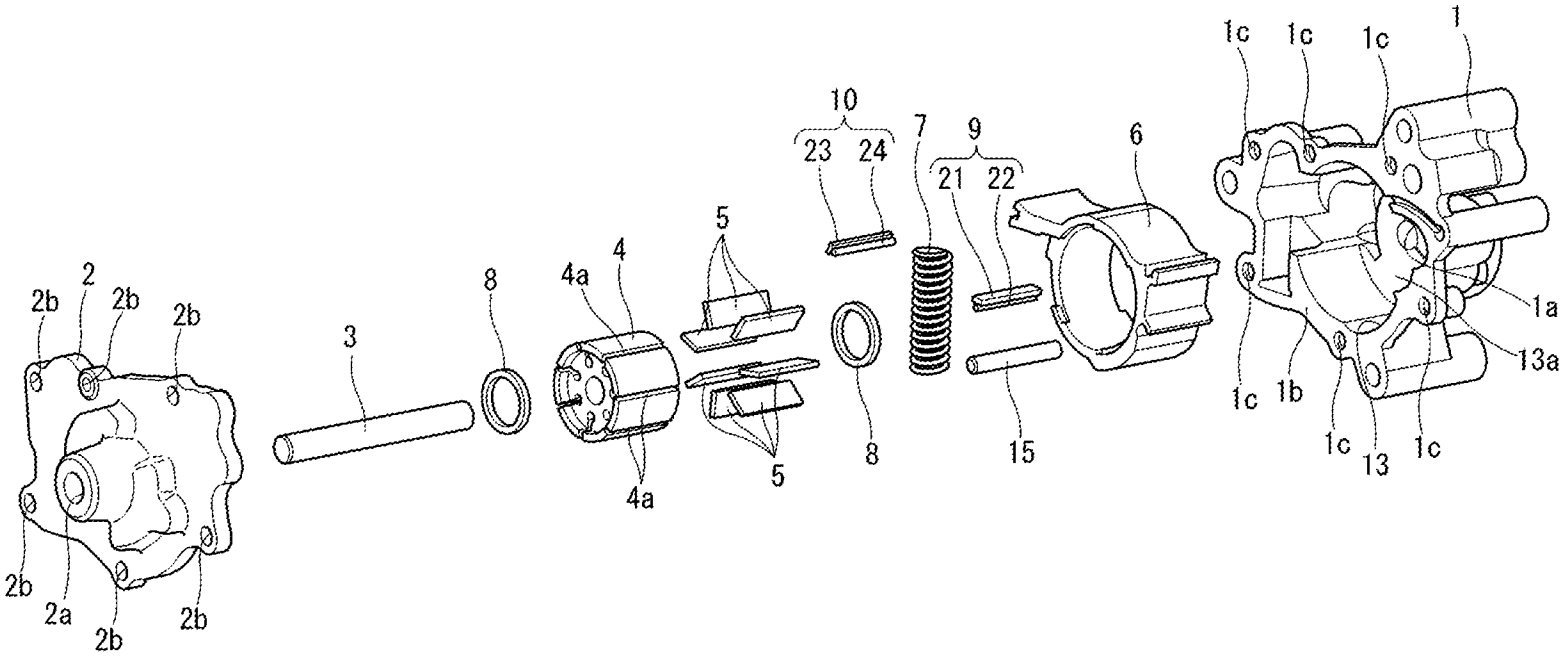
FIG. 1 is an exploded perspective view of a variable displacement pump according to a first embodiment.
Figure 2:
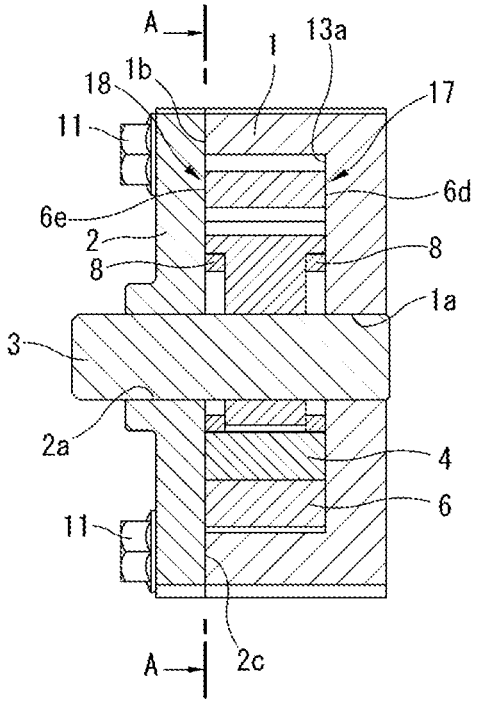
FIG. 2 is a longitudinal cross section of the variable displacement pump of the first embodiment.
Figure 3:
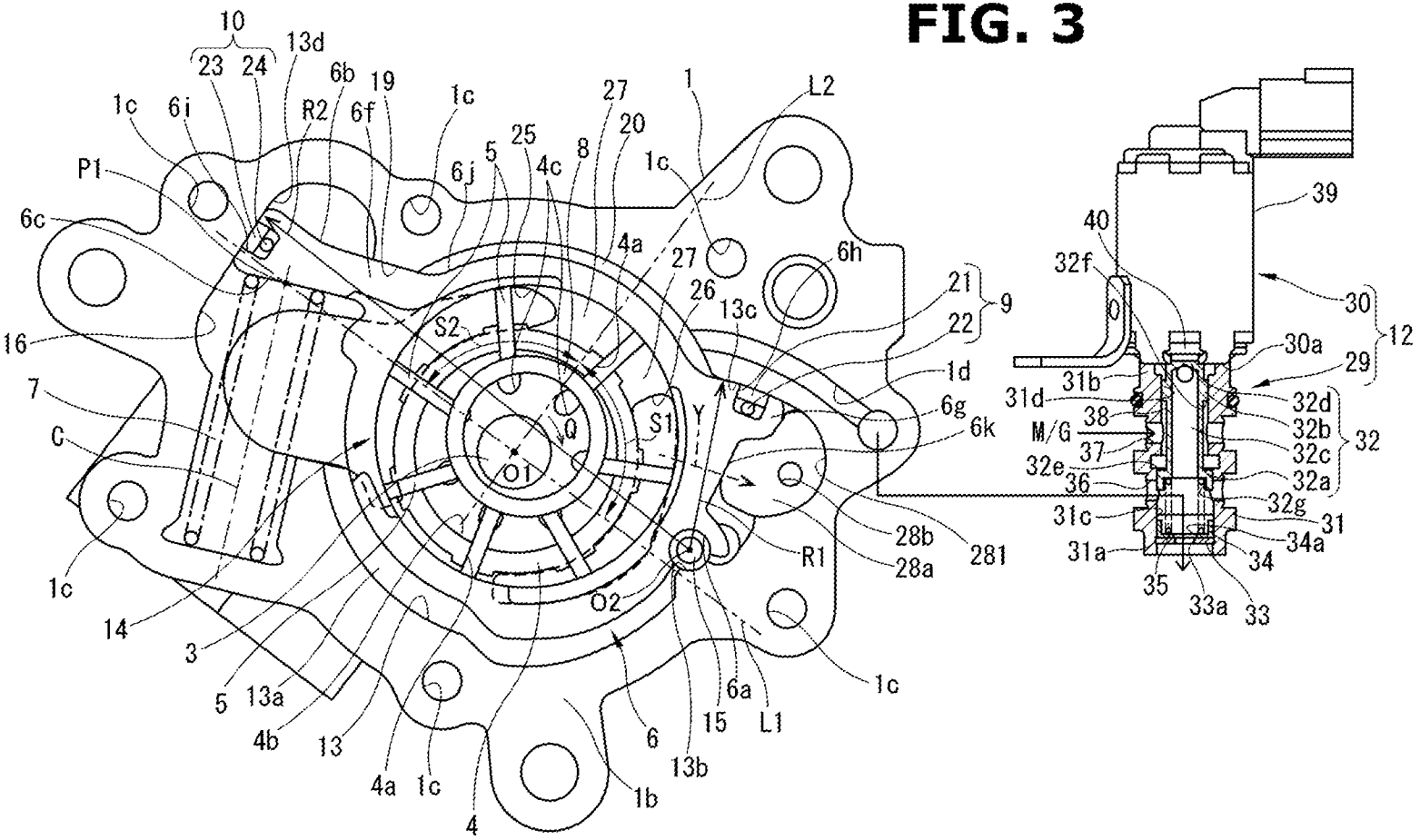
FIG. 3 is a sectional view of the variable displacement pump, cut along a line A-A of FIG. 2.

FIG. 1 is an exploded perspective view of the variable displacement pump according to a first embodiment. FIG. 2 is a longitudinal cross section of the variable displacement pump of the first embodiment. FIG. 3 is a sectional view of the variable displacement pump, cut along a line A-A of FIG. 2. FIG. 3 shows a state in which a spool valve 32 is displaced to an upper end portion 31*b* side in a valve body 31.

The variable displacement pump is configured as a vane pump that supplies oil (lubricating oil) for lubricating sliding parts in an internal combustion engine and driving a valve timing control device. The variable displacement pump has a housing body 1, a cover member 2, a driving shaft 3, a rotor 4, seven vanes 5, a cam ring 6, a first coil spring 7, a pair of ring members 8, two sealing units 9 and 10, six fixing members such as screw members 11 and a solenoid valve 12.

The housing body 1 is formed as an integral body with metal material, e.g. aluminium alloy material. The housing body 1 is formed into a closed-bottomed tubular shape having an opening at its one end side and a substantially cylindrically-recessed pump accommodating portion 13 at its inner side. The housing body 1 has, at a middle position of a bottom surface 13*a* of the pump accommodating portion 13, a first bearing hole 1*a* for rotatably supporting one end of the driving shaft 3. The housing body 1 is provided with an annularly-continuous flat mounting surface 1*b* for mounting the cover member 2 at an opening edge of the pump accommodating portion 13. Six screw holes 1*c* into which the respective screw members 11 are screwed are formed on this mounting surface 1*b*.

The cover member 2 is formed with metal material, e.g. aluminium alloy material, like the housing body 1. The cover member 2 is used so as to close the opening of the housing body 1. The cover member 2 is formed into a flat plate shape, and has an outside shape corresponding to an outside shape of the housing body 1. The cover member 2 has, at a position corresponding to the first bearing hole 1*a* of the housing body 1, a second bearing hole 2*a* for rotatably supporting the other end of the driving shaft 3. Further, the cover member 2 is provided, at positions corresponding to the six screw holes 1*c* of the housing body 1 at an outer peripheral portion of the cover member 2, with six fixing member penetration holes 2*b* into which the respective screw members 11 are inserted.

A pump housing defining or partitioning the pump accommodating portion 13 is formed by the housing body 1 and the cover member 2.

The driving shaft 3 penetrates a center part of the pump accommodating portion 13, and is rotatably supported by the pump housing. The driving shaft 3 is driven and rotated by a crankshaft (not shown). The driving shaft 3 rotates the rotor 4 in a rotation direction Q of an after-mentioned pump structure 14, i.e. in a clockwise direction in FIG. 3, by rotational force transmitted from the crankshaft. As shown in FIG. 2, the driving shaft 3 is rotatably supported by a double-sided structure of the first bearing hole 1*a* of the housing body 1 and the second bearing hole 2*a* of the cover member 2. It is noted that although the driving shaft 3 is supported by the double-sided structure in the present embodiment, the driving shaft 3 could be supported by a cantilever structure only by the first bearing hole 1*a* formed at the housing body 1. In this case, there is no need to form the second bearing hole 2*a* of the cover member 2.

The rotor 4 is cylindrical in shape, and is rotatably accommodated inside the cam ring 6 in the pump accommodating portion 13. A center portion of the rotor 4 is connected to the driving shaft 3. The rotor 4 is provided with seven slits 4*a*, each of which is formed so as to be open and extends outwards in a radial direction from an inner center side of the rotor 4. On each of both side surfaces of the rotor 4, a circular recess portion 4*b* that is recessed in a circle with the driving shaft 3 being a center is formed as an opening. The ring members 8 are slidably arranged in the respective circular recess portions 4*b*. Further, a back pressure chamber 4*c* having a circular cross section, into which a discharged oil discharged to an after-mentioned discharge port 26 is introduced, is formed at an inner side base end portion of each slit 4*a*. Each back pressure chamber 4*c* is open to the circular recess portions 4*b*. That is, the oil from the discharge port 26 flows into each of the back pressure chambers 4*c* through an oil introduction groove (not shown) formed on the bottom surface 13*a* of the pump accommodating portion 13 and the circular recess portions 4*b*. By this oil flow, each vane 5 accommodated in the slit 4*a* of the rotor 4 so as to be able to extend (protrude) from and retract into the slit 4*a* of the rotor 4 is pushed out by a centrifugal force according to rotation of the rotor 4 and a hydraulic pressure of the back pressure chamber 4*c*.

The vane 5 is formed into a thin plate shape with metal, and is accommodated in the slit 4*a* of the rotor 4 so as to be able to extend (protrude) from and retract into the slit 4*a* of the rotor 4. In a state in which the vane 5 is accommodated in the slit 4*a*, a slight gap is formed between the vane 5 and the slit 4*a*. Atop end surface of each vane 5 slidably contacts an inner circumferential surface of the cam ring 6. By this contact, a plurality of pump chambers 27 are defined between the rotor 4 and the cam ring 6. When the vane 5 protrudes, inner end surfaces of a base end portion of the vane 5 slidably contact outer circumferential surfaces of the ring members 8. Therefore, even when an engine rotation speed is low and the centrifugal force and the hydraulic pressure of the back pressure chamber 4*c* are small, each pump chamber 27 can be liquid-tightly defined with the vane 5 being in sliding contact with the inner circumferential surface of the cam ring 6.

The pump structure 14 is formed by the driving shaft 3, the rotor 4 and the vanes 5.

The cam ring 6 corresponds to an adjustment ring of the present invention. The cam ring 6 is formed into a substantially cylindrical shape as an integral ring with sintered metal. At a predetermined position at an outer peripheral portion of the cam ring 6, a substantially arc groove-shaped pivot groove 6*a* for supporting a pivot pin 15 in cooperation with an after-mentioned supporting groove 13*b* is formed by cutting along an axial direction of the driving shaft 3. The cam ring 6 is supported in the pump accommodating portion 13 of the housing body 1 so as to be able to move (pivot, rock or swing) with the pivot pin 15 being a center. Further, at a position opposite to the pivot groove 6*a* with respect to a center of the cam ring 6, an arm portion 6*b* linked to the first coil spring 7, which is a forcing member provided with a predetermined set load W1, protrudes from an outer peripheral surface of the cam ring 6 in a radial direction of the cam ring 6 and extends into a spring accommodating chamber 16. That is, a contact portion 6*c* of the arm portion 6*b*, which faces the first coil spring 7, is always in contact with a top end portion of the first coil spring 7, then the arm portion 6*b* and the first coil spring 7 are linked to each other. The cam ring 6 has a first side surface 6*d* that faces the bottom surface 13*a* of the pump accommodating portion 13 and a second side surface 6*e* that faces an inner side surface 2*c* of the cover member 2. Slight gaps (side clearances) 17 and 18 through which the oil can pass are formed between the first side surface 6*d* and the bottom surface 13*a* and between the second side surface 6*e* and the inner side surface 2*c* respectively.

The first coil spring 7 is accommodated in the spring accommodating chamber 16 provided at a position facing the pivot pin 15. The first coil spring 7 compressed by the predetermined set load W1 elastically abuts on one end wall of the spring accommodating chamber 16 and the contact portion 6*c* of the arm portion 6*b* in the spring accommodating chamber 16. Between the spring accommodating chamber 16 and the pump accommodating portion 13, a stopper surface 19 to limit a moving range of the cam ring 6 in an eccentric direction is provided. By this stopper surface, when the pump is not in operation, a root portion 6*f* of the arm portion 6*b* is pressed against the stopper surface 19 by a spring force of the first coil spring 7, and the cam ring 6 is held at a position at which an eccentric amount of the cam ring 6 with respect to a rotation center of the rotor 4 is the maximum.

The ring member 8 has an outside diameter that is smaller than an outside diameter of the rotor 4. The ring member 8 is slidably arranged in the circular recess portion 4*b* provided at the rotor 4, and as described above, assists the protrusion of the vane 5.

Here, for convenience in the following description, a reference line that passes through an intersection P1 of a center axis C of the first coil spring 7 and the contact portion 6*c* of the arm portion 6*b* of the cam ring 6 and a rotation axis O1 of the pump structure 14 is defined as a "first reference line L1". Also, a reference line that passes through the rotation axis O1 of the pump structure 14 and is orthogonal to the first reference line L1 is defined as a "second reference line L2". Further, when a side (an upper side with respect to the first reference line L1 in FIG. 3) located in an increasing direction in which an amount of the oil discharged from the after-mentioned discharge port 26 increases with respect to the first reference line L1 is defined as an "increasing side", a region located at the increasing side and at a rotation direction Q side of the pump structure 14 with respect to the second reference line L2 is defined as a "first region S1". Also, a region located at the increasing side and at an opposite direction side to the rotation direction Q side of the pump structure 14 with respect to the second reference line L2 is defined as a "second region S2".

The sealing units 9 and 10 are fixed to the cam ring 6, and partition or define a space between the cam ring 6 and the housing body 1. A control hydraulic chamber 20 is then liquid-tightly defined between the outer peripheral surface of the cam ring 6 and an inner peripheral surface of the housing body 1 in the first and second regions S1 and S2.

The sealing unit 9 is fixed to the cam ring 6 in the first region S1. The sealing unit 9 has a seal member 21 formed into a long thin plate shape along the axial direction of the driving shaft 3 with fluororesin material having low friction characteristics and an elastic member 22 formed into a long thin cylindrical column shape along the axial direction of the driving shaft 3 with rubber. The elastic member 22 presses the seal member 21 against an after-mentioned first seal contact surface 13*c* by its elastic force.

Likewise, the sealing unit 10 is fixed to the arm portion 6*b* of the cam ring 6 in the second region S2. The sealing unit 10 has a seal member 23 formed into a long thin plate shape along the axial direction of the driving shaft 3 with fluororesin material having low friction characteristics and an elastic member 24 formed into a long thin cylindrical column shape along the axial direction of the driving shaft 3 with rubber. The elastic member 24 presses the seal member 23 against an after-mentioned second seal contact surface 13*d* by its elastic force.

The arc-shaped supporting groove 13*b* that supports the cam ring 6 so that the cam ring 6 can pivot (rock or swing) through the cylindrical columnar pivot pin (a pivot portion) 15 is formed at a predetermined position of an inner peripheral wall of the pump accommodating portion 13. The supporting groove 13*b* supporting the pivot pin 15 is provided so as to be adjacent to an after-mentioned first low pressure chamber 281 in the rotation direction Q of the pump structure 14.

The first seal contact surface 13*c* is formed on the inner peripheral wall of the pump accommodating portion 13 in the first region S1. The seal member 21 provided at the outer peripheral portion of the cam ring 6 slidably contacts this first seal contact surface 13*c*. As shown in FIG. 3, the first seal contact surface 13*c* is an arc surface formed by a predetermined radius R1 from a center O2 of the pivot pin 15. The radius R1 is set to a circumferential direction length by which the seal member 21 can always be in sliding contact with the first seal contact surface 13*c* within an eccentric swing range (or an eccentric movement range) of the cam ring 6.

Likewise, the second seal contact surface 13*d* is formed on the inner peripheral wall of the pump accommodating portion 13 in the second region S2. The seal member 23 provided at a top end portion of the arm portion 6*b* of the cam ring 6 slidably contacts this second seal contact surface 13*d*. As shown in FIG. 3, the second seal contact surface 13*d* is a surface formed by a predetermined radius R2, which is greater than the radius R1, from the center O2 of the pivot pin 15. The radius R2 is set to a circumferential direction length by which the seal member 23 can always be in sliding contact with the second seal contact surface 13*d* within the eccentric swing range (or the eccentric movement range) of the cam ring 6.

At the outer peripheral portion of the cam ring 6, as shown in FIG. 3, a first seal holding portion 6*g* having a first seal surface protrudes at a position facing the first seal contact surface 13*c*. Here, the first seal surface is formed by a predetermined radius, which is slightly smaller than the radius R1 that forms the corresponding first seal contact surface 13*c*, from the center O2 of the pivot pin 15. A minute clearance is formed between the first seal surface and the first seal contact surface 13*c*. On the first seal surface of the first seal holding portion 6*g*, a first seal holding groove 6*h* having a U-shape in cross section is formed along an axial direction of the cam ring 6. The sealing unit 9 that contacts the first seal contact surface 13*c* when the cam ring 6 eccentrically moves (pivots, rocks or swings) is held in the first seal holding groove 6*h*.

The top end portion of the arm portion 6*b* of the cam ring 6 has a second seal surface at a position facing the second seal contact surface 13*d*. Here, the second seal surface is formed by a predetermined radius, which is slightly smaller than the radius R2 that forms the corresponding second seal contact surface 13*d*, from the center O2 of the pivot pin 15. A minute clearance is formed between the second seal surface and the second seal contact surface 13*d*. On the second seal surface of the arm portion 6*b*, a second seal holding groove 6*i* having a U-shape in cross section is formed along the axial direction of the cam ring 6. The sealing unit 10 that contacts the second seal contact surface 13*d* when the cam ring 6 eccentrically moves (pivots, rocks or swings) is held in the second seal holding groove 6*i*.

The control hydraulic chamber 20 is provided at a position that does not overlap with the after-mentioned discharge port 26 in a radial direction of the pump structure 14 with respect to the rotation axis O1 (i.e. in a radial direction of the pump structure 14). A pump discharge pressure is introduced into the control hydraulic chamber 20 through the solenoid valve 12 and a communication groove 1*d* formed on the mounting surface 1*b* of the housing body 1. The control hydraulic chamber 20 is configured so that when the cam ring 6 moves in a direction in which a discharge amount of the oil decreases, a volume of the control hydraulic chamber 20 increases.

A surface, which is adjacent to the control hydraulic chamber 20, of the outer peripheral surface of the cam ring 6 is a pressure receiving surface 6*j* that receives the pump discharge pressure introduced into the control hydraulic chamber 20. The pump discharge pressure acts on the pressure receiving surface 6*j*, then by balance between an urging force based on the hydraulic pressure acting on the pressure receiving surface 6*j* and an urging force by the first coil spring 7, the eccentric amount of the cam ring 6 is controlled.

Therefore, in the variable displacement pump, when the urging force based on the hydraulic pressure of the control hydraulic chamber 20 is smaller than the set load W1 of the first coil spring 7, the cam ring 6 is in the most eccentric state as shown in FIG. 3. On the other hand, when the urging force based on the hydraulic pressure of the control hydraulic chamber 20 exceeds the set load W1 of the first coil spring 7 as the pump discharge pressure rises, the cam ring 6 moves in a concentric direction according to the pump discharge pressure.

As shown in FIG. 3, on the bottom surface 13*a* of the pump accommodating portion 13, a suction port 25 (shown by a solid line and a broken line in FIG. 3) as an arc-recessed suction portion and the discharge port 26 (shown by a solid line and a broken line in FIG. 3) likewise as an arc-recessed discharge portion are formed by cutting so as to face each other with respect to the driving shaft 3 in an outer peripheral region of the driving shaft 3.

The suction port 25 is located at an opposite side to the supporting groove 13*b* on the bottom surface 13*a*, and is open in a region (a suction region) where an internal volume of each pump chamber 27 increases according to pumping action of the pump structure 14. An introduction port (not shown) is formed integrally with the suction port 25 at a middle position in a circumferential direction of the suction port 25 so as to bulge toward the after-mentioned spring accommodating chamber 16. Further, a suction hole (not shown) that penetrates a bottom wall of the housing body 1 and is open to the outside is provided at a predetermined position of the suction port 25. By this structure, the lubricating oil stored in an oil pan of the internal combustion engine (both not shown) is sucked into each pump chamber 27 in the suction region through the suction hole and the suction port 25 on the basis of a negative pressure generated according to the pumping action of the pump structure 14.

On the other hand, the discharge port 26 is located at the pivot pin 15 side, and is open in a region (a discharge region) where the internal volume of each pump chamber 27 decreases according to the pumping action of the pump structure 14. A discharge hole (not shown) that penetrates the bottom wall of the housing body 1 and is open to the outside is provided close to a start end portion of the discharge port 26. By this structure, the oil pressurized by the pumping action and discharged to the discharge port 26 is supplied to the sliding parts in the internal combustion engine and the valve timing control device etc. from the discharge hole through a main oil gallery (M/G).

Further, in a region between the supporting groove 13*b* and the communication groove 1*d* on the mounting surface 1*b* of the housing body 1, the first low pressure chamber 281 sealed by the pivot pin 15 having a sealing function and the sealing unit 9 and recessed from the mounting surface 1*b* is formed. This first low pressure chamber 281 is provided at a position that overlaps with the discharge port 26 between the pump accommodating portion 13 and the cam ring 6 in the radial direction of the pump structure 14 with respect to the rotation axis O1. A bottom surface 28*a* of the first low pressure chamber 281 is provided at a lower position (a depth side position with respect to a paper surface of FIG. 3) than the bottom surface 13*a* of the pump accommodating portion 13. A drain hole 28*b* that communicates with a low pressure portion located outside the housing body 1 (located at an external portion of the housing body 1) is formed on the bottom surface 28*a* of the first low pressure chamber 281 by penetrating the bottom surface 28*a* along a direction of the rotation axis O1 of the pump structure 14. The low pressure portion has pressure that is equal to or less than a hydraulic pressure (the pump discharge pressure) of the oil discharged from the discharge port 26. In the present embodiment, the low pressure portion is the oil pan (not shown) having atmospheric pressure. The oil from the discharge port 26, whose pressure is higher than that in the first low pressure chamber 281, flows into the first low pressure chamber 281 communicating with the low pressure portion by a pressure difference between the discharge port 26 and the first low pressure chamber 281 through the slight gap 17 between the cam ring 6 and the housing body 1 (the pump accommodating portion 13) and the slight gap 18 between the cam ring 6 and the cover member 2 (see an arrow Y of a broken line in FIG. 3). The oil flowing into the first low pressure chamber 281 is drained to the oil pan (not shown) through the drain hole 28*b*.

The outer peripheral surface of the cam ring 6, which faces the first low pressure chamber 281, is a pressure receiving surface 6*k* that receives a hydraulic pressure of the first low pressure chamber 281.

The solenoid valve 12 corresponds to a control valve of the present invention. The solenoid valve 12 controls the eccentric amount of the cam ring 6 by electrically controlling supply and discharge of the oil to and from the control hydraulic chamber 20, thereby regulating a main gallery pressure P. The solenoid valve 12 has a valve part 29 for the supply and discharge of the oil according to an axial direction position in a moving direction of the after-mentioned spool valve 32 and a solenoid part 30 for controlling the axial direction position of the spool valve 32 by energization.

The valve part 29 has a substantially cylindrical valve body 31, the spool valve 32 slidably installed in the valve body 31, a stopper 33 fixed to an inner peripheral portion of the valve body 31, a retainer 34 abutting on this stopper 33 and a second coil spring 35 installed between the retainer 34 and the spool valve 32 and provided with a predetermined set load W2.

The valve body 31 has a supply/discharge port 36 provided at a position on a lower end portion 31*a* side on a peripheral wall of the valve body 31 and communicating with the control hydraulic chamber 20 through the communication groove 1*d* of the housing body 1 and a connecting port 37 provided at an upper end portion 31*b* side with respect to the supply/discharge port 36 on the peripheral wall and communicating with the main oil gallery (M/G) with both the supply/discharge port 36 and the connecting port 37 penetrating the valve body 31 in a radial direction. The valve body 31 also has a large diameter portion 31*c* and a small diameter portion 31*d* having an inside diameter that is smaller than that of the large diameter portion 31*c*.

The spool valve 32 has a cylindrical columnar first land portion 32*a* slidably located in the large diameter portion 31*c*, a cylindrical columnar second land portion 32*b* slidably located in the small diameter portion 31*d*, a cylindrical columnar connecting portion 32*c* connecting the first land portion 32*a* and the second land portion 32*b* and a cylindrical columnar shaft portion 32*d* formed integrally with the second land portion 32*b*.

The first land portion 32*a* has an outside diameter that is slightly smaller than the inside diameter of the large diameter portion 31*c*. An axial direction end surface, at the upper end portion 31*b* side, of the first land portion 32*a* is an annular first pressure receiving surface 32*e* that receives the main gallery pressure P from the main oil gallery (M/G). An axial direction end surface, at the lower end portion 31*a* side, of the first land portion 32*a* is provided with a circular recess groove portion 32*g* on which the second coil spring 35 elastically abuts.

The second land portion 32*b* has an outside diameter that is slightly smaller than the inside diameter of the small diameter portion 31*d*. An axial direction end surface, at the lower end portion 31*a* side, of the second land portion 32*b* is an annular second pressure receiving surface 32*f* that receives the main gallery pressure P from the main oil gallery (M/G). A pressure receiving area of the second pressure receiving surface 32*f* is set to be smaller than a pressure receiving area of the first pressure receiving surface 32*e*.

The connecting portion 32*c* has an outside diameter that is smaller than the outside diameters of the first and second land portion 32*a* and 32*b*. An annular passage 38 continuing in an annular shape is formed between the connecting portion 32*c*, the first land portion 32*a* and the second land portion 32*b*. The connecting port 37 always communicates with this annular passage 38 with maximum opening regardless of the axial direction position of the spool valve 32. The main gallery pressure P from the main oil gallery (M/G) is supplied to the annular passage 38. By multiplying a difference in the pressure receiving area between the first pressure receiving surface 32*e* of the first land portion 32*a* and the second pressure receiving surface 32*f* of the second land portion 32*b* by the main gallery pressure P of the annular passage 38, a hydraulic pressure force Fp that forces the spool valve 32 toward the lower end portion 31*a* is calculated.

One end in the axial direction of the shaft portion 32*d* is formed integrally with the second land portion 32*b*. The other end in the axial direction of the shaft portion 32*d* can abut on an after-mentioned push rod 40.

The stopper 33 is annular in shape, and is fixed to a position on the lower end portion 31*a* side at the inner peripheral portion of the valve body 3*l*. The stopper 33 has a circular drain hole 33*a* that communicates with the oil pan (not shown) as the low pressure portion. This drain hole 33*a* is structured so that the oil flowing through the control hydraulic chamber 20, the communication groove 1*d*, the large diameter portion 31*c* and an after-mentioned hole portion 34*a* of the retainer 34 is drained to the oil pan according to the axial direction position of the spool valve 32.

The retainer 34 has a closed-bottomed tubular shape. The retainer 34 is located in the large diameter portion 31*c* so that a bottom portion of the retainer 34 abuts on an end surface, at the upper end portion 31*b* side, of the stopper 33. The circular hole portion 34*a* through which the large diameter portion 31*c* and the drain hole 33*a* of the stopper 33 communicate with each other is formed at the bottom portion of the retainer 34 by penetrating the bottom portion of the retainer 34.

The second coil spring 35 is elastically installed between the bottom portion of the retainer 34 and a bottom surface of the recess groove portion 32*g* formed at the first land portion 32*a* in the large diameter portion 31*c*. The second coil spring 35 always forces the spool valve 32 toward the solenoid part 30.

With regard to the solenoid part 30, an electromagnetic coil, a stator core, a movable core, etc. (all not shown) are accommodated in a casing 39, and the cylindrical columnar push rod 40 is connected to a top end portion of the movable core. A top end portion of the push rod 40 can abut on the axial direction other end of the shaft portion 32*d*. When a pulse voltage is applied to the electromagnetic coil of the solenoid part 30 from an electronic controller (not shown), a thrust according to a voltage value of the pulse voltage acts on the movable core. The spool valve 32 is configured to move forward and backward on the bases of a relative difference between a resultant force Fp+Fr of the hydraulic pressure force Fp acting on the spool valve 32 and the thrust of the movable core transmitted through the push rod 40 (a pressing force Fr of the push rod 40) and a spring force Fs of the second coil spring 35.

The electronic controller is a controller using a so-called PWM (Pulse Width Modulation) method. The electronic controller is configured to steplessly control the voltage value of the pulse voltage applied to the electromagnetic coil by modulating a pulse width of the pulse voltage applied to the electromagnetic coil, i.e. by changing a duty ratio D. Further, the electronic controller is configured to detect an engine operating condition from an oil temperature and a water temperature of the engine, an engine rotation speed, a load, etc., and especially when the engine is in a low rotation speed state such as an engine start state, to cut off the energization to the electromagnetic coil, and when the engine rotation speed N is a predetermined speed or more, to energize the electromagnetic coil to regulate the main gallery pressure P.

Figure 4:
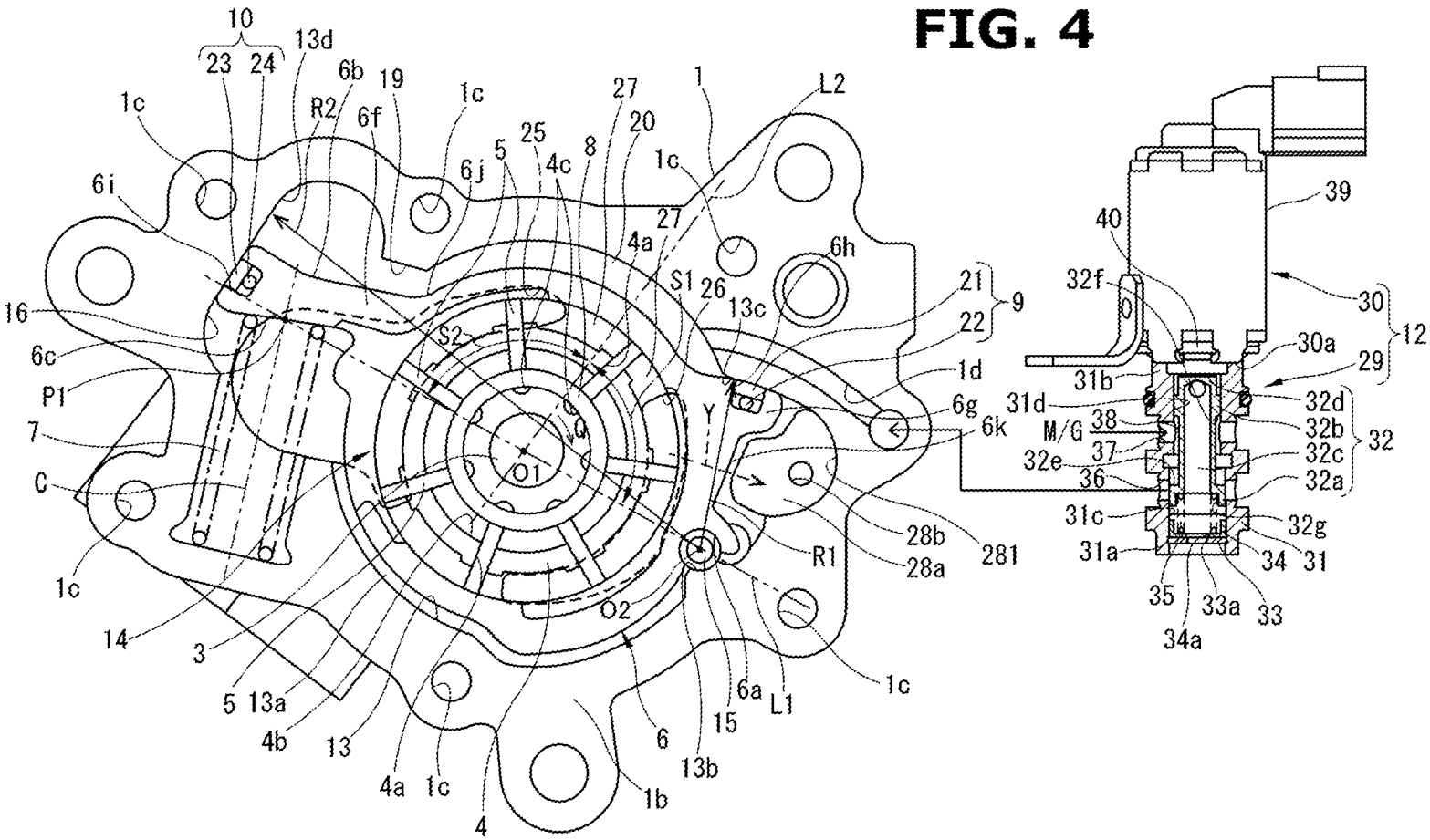
FIG. 4 is a sectional view of the variable displacement pump in a state in which a spool valve of a solenoid valve is forced at a lower end side of a valve body.
Figure 5:
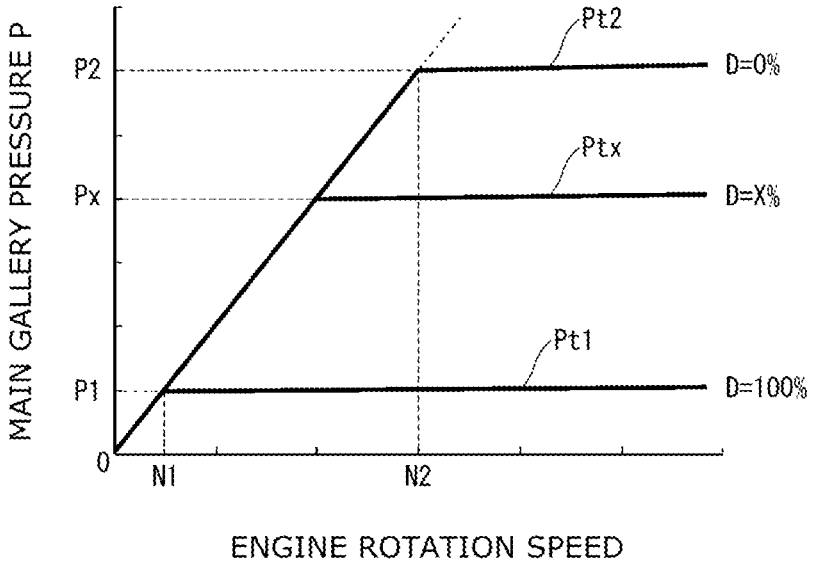
FIG. 5 is a characteristic diagram of the variable displacement pump of the present embodiment, showing a correlation between an engine rotation speed and a main gallery pressure.

FIG. 4 is a sectional view of the variable displacement pump, showing a state in which the spool valve 32 is displaced to the lower end portion 31*a* side in the valve body 31. FIG. 5 is a characteristic diagram of the variable displacement pump of the present embodiment, showing a correlation between the engine rotation speed N and the main gallery pressure P.

An operation of the solenoid valve 12 and an operation (an action) of the cam ring 6 by the operation of the solenoid valve 12 will be described below.

When the electromagnetic coil of the solenoid valve 12 is not energized, i.e. when the duty ratio D is 0%, the spool valve 32 moves in the axial direction in the valve body 31 on the bases of the hydraulic pressure force Fp acting on the spool valve 32 and the spring force Fs of the second coil spring 35. More specifically, when the hydraulic pressure force Fp is greater than the spring force Fs, the spool valve 32 moves to the lower end portion 31*a* side of the valve body 31, whereas when the spring force Fs is greater than the hydraulic pressure force Fp, the spool valve 32 moves to the upper end portion 31*b* side of the valve body 31.

When the engine rotation speed N is a predetermined engine rotation speed N2 or less, the main gallery pressure P is a predetermined value P2 or less. Here, the predetermined value P2 indicates an engine required hydraulic pressure required to lubricate bearing portions of the crankshaft at the time of high engine rotation speed. Further, the hydraulic pressure force Fp that is in a proportional relationship with the main gallery pressure P is a predetermined value or less, and the spool valve 32 is located at a position on the solenoid part 30 side (at a position of the spool valve 32 shown in FIG. 3). At this time, the supply/discharge port 36 and the large diameter portion 31*c* communicate with each other with communication between the supply/discharge port 36 and the annular passage 38 being blocked by an outer peripheral surface of the first land portion 32*a*. As a result, oil from the control hydraulic chamber 20 is drained to the oil pan through the communication groove 1*d*, the supply/discharge port 36, the large diameter portion 31*c*, the hole portion 34*a* and the drain hole 33*a*. Then, the hydraulic pressure in the control hydraulic chamber 20 decreases, and the first coil spring 7 presses the cam ring 6 on the stopper surface 19 by the spring force of the first coil spring 7 against the hydraulic pressure of the control hydraulic chamber 20. Therefore, the cam ring 6 is located at the most eccentric position (a position of the cam ring 6 shown in FIG. 3), and the eccentric amount becomes the maximum. Thus, as shown in FIG. 5, when the engine rotation speed N is the predetermined engine rotation speed N2 or less, the main gallery pressure P changes according to the engine rotation speed N with the maximum capacity.

Further, when the main gallery pressure P attempts to exceed the predetermined value P2 in a state in which the engine rotation speed N is higher than the predetermined engine rotation speed N2, the hydraulic pressure force Fp becomes greater than the predetermined value, and the spool valve 32 moves to a position (a position of the spool valve 32 shown in FIG. 4) that is separate from the solenoid part 30 to the lower end portion 31*a* side by a predetermined distance. Here, since the duty ratio D is 0% during this movement of the spool valve 32, the push rod 40 is located at the most retracted position, and is separate from the axial direction other end of the shaft portion 32*d* of the spool valve 32. Further, the supply/discharge port 36 communicates with the annular passage 38, and oil from the main oil gallery (M/G) is supplied to the control hydraulic chamber 20 through the annular passage 38, the supply/discharge port 36 and the communication groove 1*d*. As a result, the hydraulic pressure in the control hydraulic chamber 20 becomes high, and this hydraulic pressure forces the cam ring 6 to the first coil spring 7 side (in a counterclockwise direction in FIG. 4) against the spring force of the first coil spring 7. The cam ring 6 then moves to a position away from the stopper surface 19, and the eccentric amount becomes small. The discharge amount of the variable displacement pump decreases by and according to this movement, and the main gallery pressure P decreases toward the predetermined value P2. Further, when the main gallery pressure P attempts to decrease to the predetermined value P2 or less, the hydraulic pressure in the control hydraulic chamber 20 becomes low again, and the cam ring 6 moves to the position on the stopper surface 19 side, then the capacity is increased.

In this manner, when the main gallery pressure P is lower than the predetermined value P2, the spool valve 32 is located at the position on the solenoid part 30 side, and the control hydraulic chamber 20 and the oil pan communicate with each other. On the other hand, when the main gallery pressure P attempts to exceed the predetermined value P2, the spool valve 32 is located at the position away from the solenoid part 30, and the control hydraulic chamber 20 and the main oil gallery (M/G) communicate with each other. By this configuration, the main gallery pressure P is maintained at the predetermined value P2 and within a range (a control hydraulic pressure Pt2) close to the predetermined value P2.

Further, when the electromagnetic coil of the solenoid valve 12 is energized, i.e. when the duty ratio D is X ($0<X<100$) %, the spool valve 32 moves in the axial direction in the valve body 31 on the bases of the resultant force Fp+Fr of the hydraulic pressure force Fp acting on the spool valve 32 and the pressing force Fr of the push rod 40 and the spring force Fs of the second coil spring 35. More specifically, when the resultant force Fp+Fr is greater than the spring force Fs, the spool valve 32 moves to the lower end portion 31*a* side of the valve body 31, whereas when the spring force Fs is greater than the resultant force Fp+Fr, the spool valve 32 moves to the upper end portion 31*b* side of the valve body 31. Since the pressing force Fr assists the hydraulic pressure force Fp when the spool valve 32 moves to the lower end portion 31*a* side of the valve body 31, the main gallery pressure P moves the spool valve 32 with a predetermined pressure Px that is lower than the predetermined value P2. By and according to this movement, a control hydraulic pressure that is controlled by the spool valve 32 also becomes a predetermined control hydraulic pressure Ptx that is lower than the control hydraulic pressure Pt2. Further, when the duty ratio D is a maximum value, i.e. when the duty ratio D is 100%, a control hydraulic pressure Pt1 controlled by the spool valve 32 becomes P1 that is a lowest hydraulic pressure.

When the engine is in the low rotation speed state such as an engine start state, i.e. when the engine rotation speed N is lower than N1, the energization to the electromagnetic coil is cut off, and the duty ratio D is 0%.

Effect of First Embodiment

Figure 6:
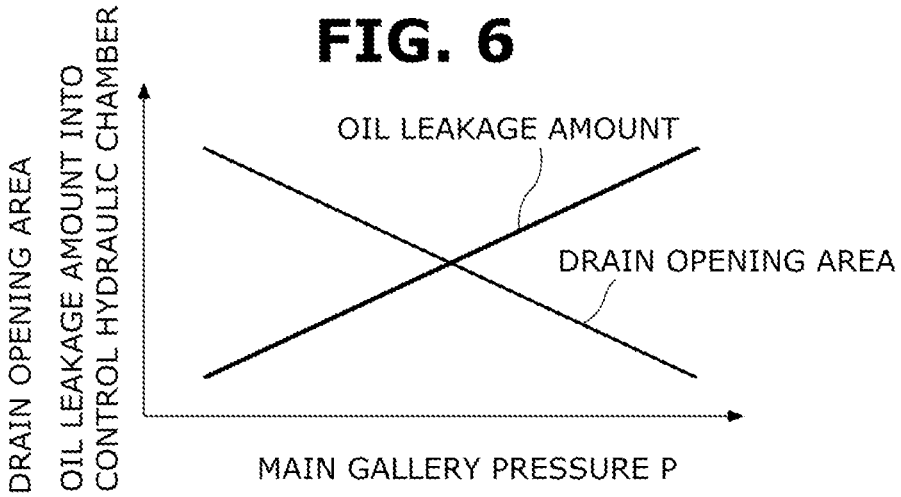
FIG. 6 is a graph of a conventional variable displacement pump, showing a correlation between the main gallery pressure and a drain opening area and an oil leakage amount into a control hydraulic chamber.
Figure 7:
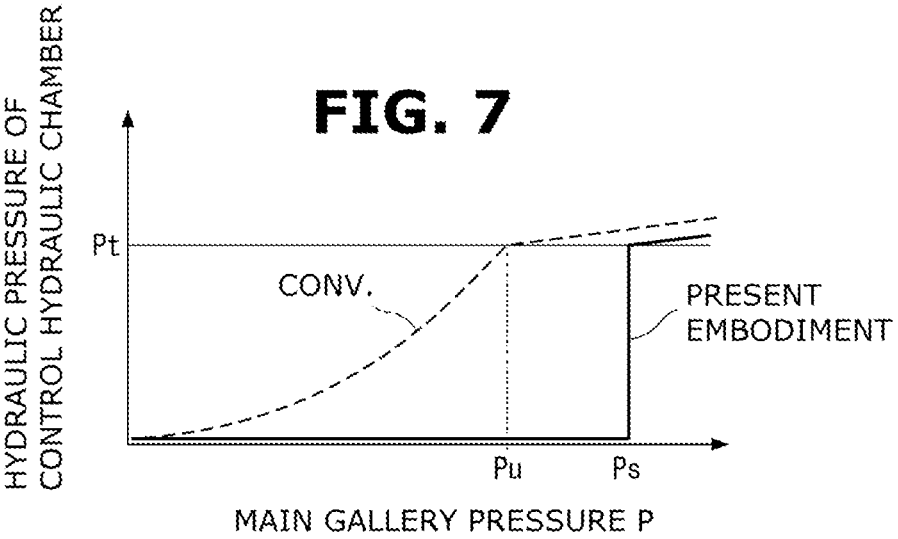
FIG. 7 is a graph of the conventional variable displacement pump and the variable displacement pump of the first embodiment, showing a correlation between the main gallery pressure and hydraulic pressure of the control hydraulic chamber.

FIG. 6 is a graph of a conventional variable displacement pump, showing a correlation between the main gallery pressure P and a drain opening area and an oil leakage amount into the control hydraulic chamber 20. FIG. 7 is a graph of the conventional variable displacement pump and the variable displacement pump of the first embodiment, showing a correlation between the main gallery pressure P and the hydraulic pressure of the control hydraulic chamber 20. In FIG. 7, change of the hydraulic pressure of the control hydraulic chamber of the conventional variable displacement pump is shown by a broken line, and change of the hydraulic pressure of the control hydraulic chamber 20 of the present embodiment is shown by a solid line.

In the conventional variable displacement pump, as shown in FIG. 6, when the main gallery pressure P increases with increase in the engine rotation speed, the oil leakage amount into the control hydraulic chamber increases at a constant rate. That is, when the main gallery pressure P increases, the leakage amount of the oil leaking into the control hydraulic chamber from the discharge port through the slight gap (the side clearance) between the cam ring and the pump housing increases at a constant rate. This oil leakage amount increases as the side clearance becomes larger. Further, a viscosity of the oil decreases as the oil temperature is higher, and the oil easily passes through the side clearance, then the oil leakage amount increases.

On the other hand, when the main gallery pressure P increases, the hydraulic pressure from the main oil gallery acts on the spool valve of the control valve, and the drain opening area of the control valve for drain of the oil of the control hydraulic chamber, i.e. an opening area of the supply/discharge port, is narrowed by the spool valve. That is, as shown in FIG. 6, when the main gallery pressure P increases, the drain opening area decreases at a constant rate.

Here, when the drain opening area is insufficient for the oil leakage amount, as shown in FIG. 7, at a stage at which the main gallery pressure P reaches a pressure Pu that is lower than a predetermined pressure Ps, the hydraulic pressure of the control hydraulic chamber increases and reaches an operating pressure (a working pressure) Pt of the cam ring, then the cam ring is operated. As a consequence, there is a risk that supply of a desired hydraulic pressure into the internal combustion engine will be suppressed.

In contrast to this, in the present embodiment, the variable displacement pump has the first low pressure chamber 281 provided at the position that overlaps with the discharge port 26 between the pump accommodating portion 13 and the cam ring 6 in the radial direction of the pump structure 14 with respect to the rotation axis O1. Therefore, by and according to the increase in the main gallery pressure P, the oil in the discharge port 26 flows into the first low pressure chamber 281 by the pressure difference between the discharge port 26 and the first low pressure chamber 281 through the slight gap 17 between the cam ring 6 and the housing body 1 (the pump accommodating portion 13) and the slight gap 18 between the cam ring 6 and the cover member 2. Thus, the oil leakage from the discharge port 26 into the control hydraulic chamber 20 is suppressed, and as shown by the solid line in FIG. 7, the hydraulic pressure of the control hydraulic chamber 20 does not rise until the main gallery pressure P reaches the predetermined pressure Ps. Then, when the main gallery pressure P reaches the predetermined pressure Ps, the hydraulic pressure of the control hydraulic chamber 20 becomes the operating pressure Pt of the cam ring 6, and the oil is supplied to the control hydraulic chamber 20 by diverting of the spool valve 32, then the cam ring 6 is operated. It is therefore possible to supply the desired hydraulic pressure into the internal combustion engine while suppressing the operation (the action) of the cam ring 6 in the state in which the main gallery pressure P is lower than the predetermined pressure Ps.

In addition, in the present embodiment, the drain hole 28*b* communicating with the oil pan having atmospheric pressure is formed on the bottom surface 28*a* of the first low pressure chamber 281 by penetrating the bottom surface 28*a* along the direction of the rotation axis O1 of the pump structure 14.

If the oil leaking into the first low pressure chamber 281 is returned to the suction port 25 through a groove formed on the mounting surface 1*b* of the housing body 1 without providing the drain hole 28*b*, there is a need to form the groove so as to bypass the pump structure 14 in the radial direction of the pump structure 14. This requires securing a thickness of the housing body 1 by an amount of the bypass of the groove. Consequently, there is a risk that size of the variable displacement pump will be increased in the radial direction of the pump structure 14.

However, in the present embodiment, by forming the relatively short drain hole 28*b* on the bottom surface 28*a* of the first low pressure chamber 281 by penetrating the bottom surface 28*a*, as compared with the case where the groove for returning the oil to the suction port 25 is formed, the size of the variable displacement pump can be decreased.

Furthermore, in the present embodiment, the control hydraulic chamber 20 is provided at the position that does not overlap with the discharge port 26 in the radial direction of the pump structure 14. By this arrangement, the oil hardly leaks from the discharge port 26 into the control hydraulic chamber 20. Therefore, an early operation (or an early action) of the cam ring 6 due to the oil leaking into the control hydraulic chamber 20 is suppressed, and the desired oil can be supplied to the internal combustion engine.

Second Embodiment

Figure 8:
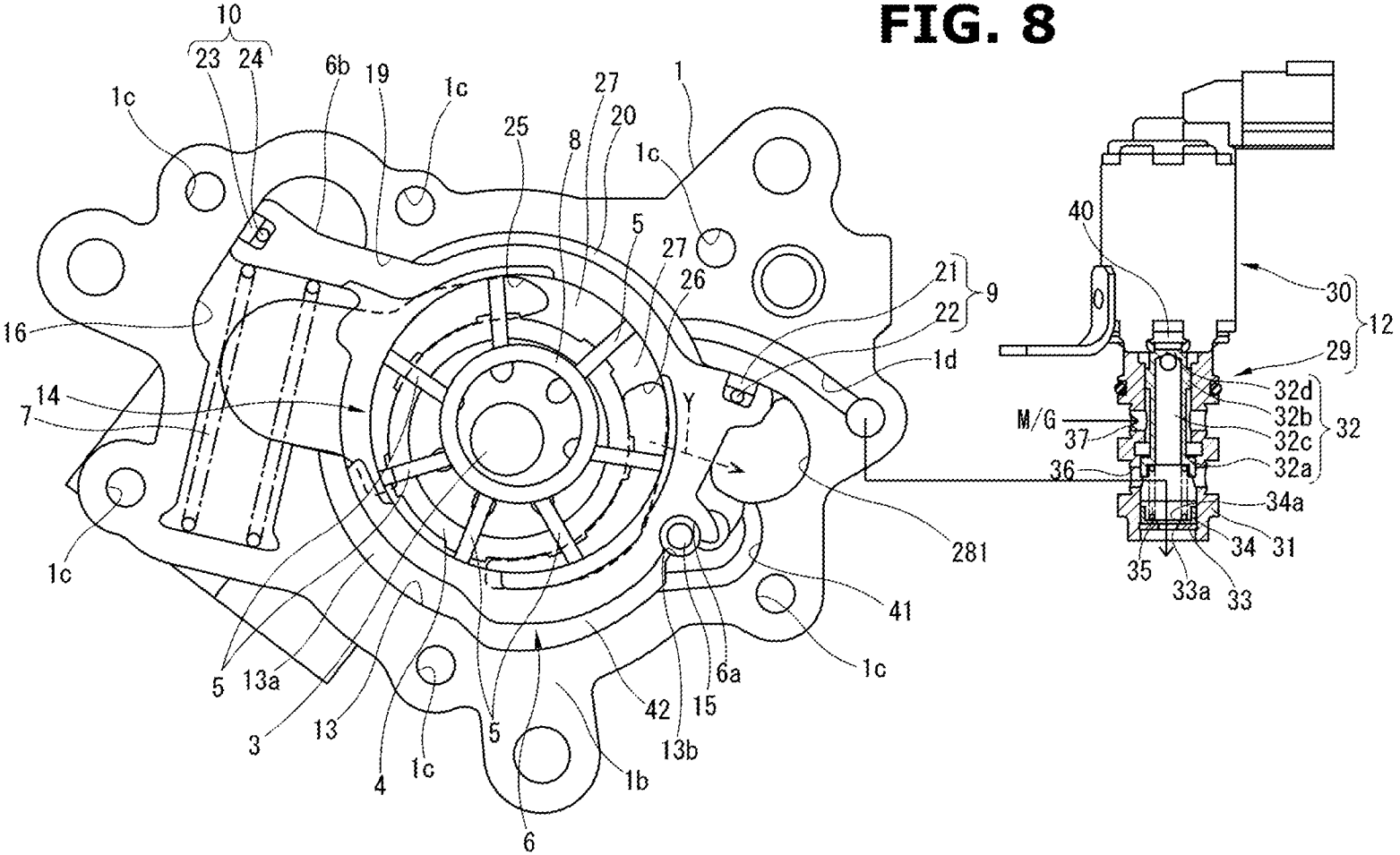
FIG. 8 is a sectional view of a variable displacement pump according to a second embodiment.

FIG. 8 is a sectional view of a variable displacement pump according to a second embodiment.

In the second embodiment, the drain hole 28*b* of the first low pressure chamber 281 of the first embodiment is removed, and a suction portion returning passage 41 that is open on the mounting surface 1*b* of the housing body 1 and returns the oil in the first low pressure chamber 281 to the suction port 25 side is formed on the mounting surface 1*b* of the housing body 1. As shown in FIG. 8, the suction portion returning passage 41 is formed as an arc-shaped groove that extends from an edge portion of the first low pressure chamber 281 through a side (an outer side) of the pivot pin 15 and is connected to a space 42 between an inner peripheral surface of the pump accommodating portion 13 and the outer peripheral surface of the cam ring 6 at a position relatively close to the pivot pin 15, when viewed from a direction orthogonal to the mounting surface 1*b* of the housing body 1. However, connecting positions of the suction portion returning passage 41 to the first low pressure chamber 281 and to the space 42 are not limited to positions of FIG. 8, but other connecting positions can be possible. Oil flowing into the space 42 through the suction portion returning passage 41 is returned to the suction port 25 through the slight gap 17 (see FIG. 2) between the cam ring 6 and the housing body 1 (the pump accommodating portion 13).

Here, the suction portion returning passage 41 is not formed at the housing body 1, but could be formed on a mating surface of the cover member 2.

Effect of Second Embodiment

In the second embodiment, the oil in the first low pressure chamber 281 is returned to the suction port 25 through the suction portion returning passage 41 formed on the mounting surface 1*b* of the housing body 1 and the space 42. Therefore, since there is no need to drain the oil in the first low pressure chamber 281 to the oil pan and to supply the oil to the suction port 25 again through an oil strainer, it is possible to improve efficiency of the variable displacement pump.

Further, in the present embodiment, the suction portion returning passage 41 is provided at an outer peripheral side with respect to the cam ring 6 in the radial direction of the pump structure 14.

If the suction portion returning passage 41 is formed at the cam ring 6, there is a need to increase size of the cam ring 6 in the radial direction by a width of the suction portion returning passage 41.

However, by providing the suction portion returning passage 41 at the outer peripheral side with respect to the cam ring 6 like the present embodiment, there is no need to form the suction portion returning passage 41 at the cam ring 6, then size reduction of the cam ring 6 is possible.

Third Embodiment

Figure 9:
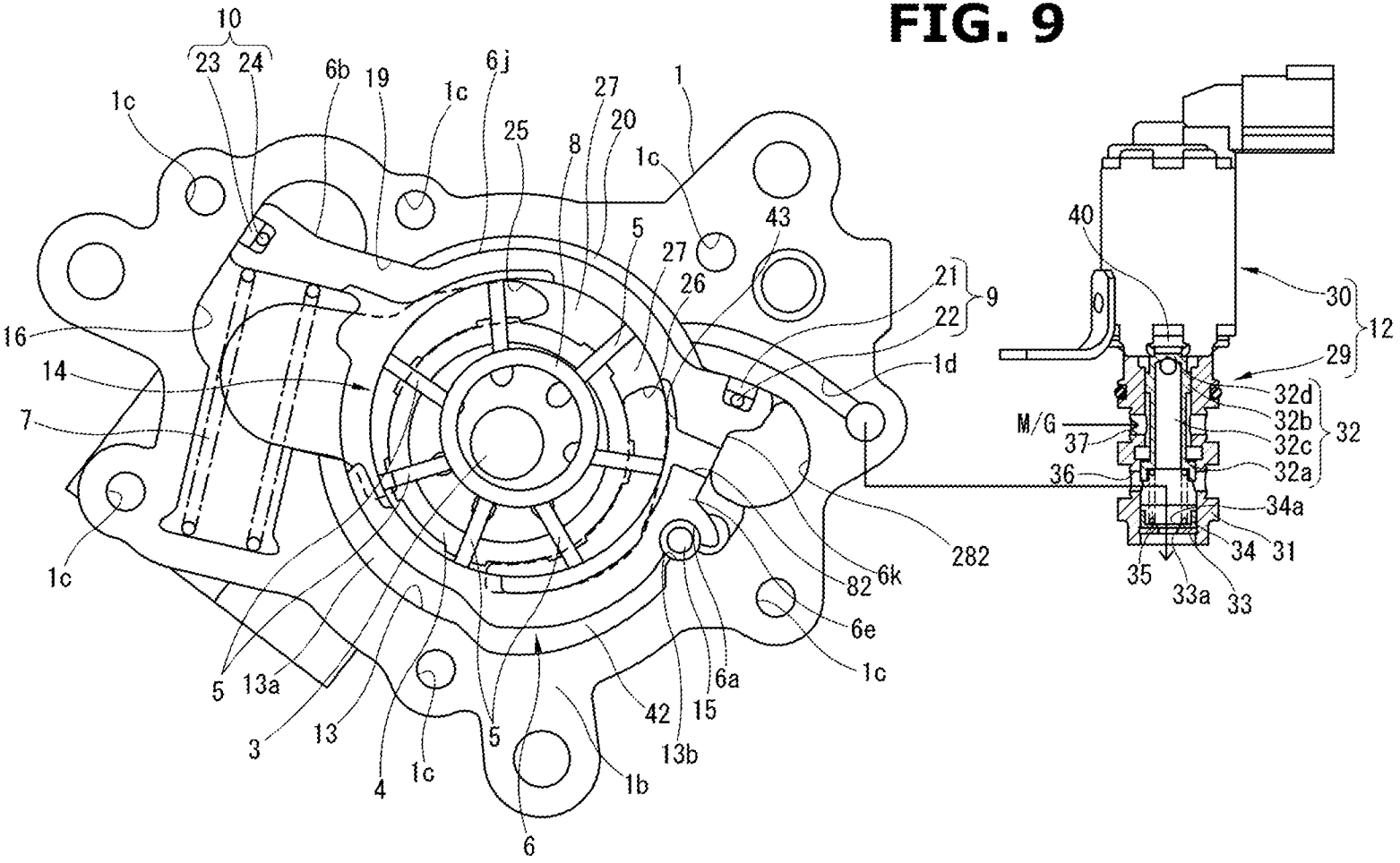
FIG. 9 is a sectional view of a variable displacement pump according to a third embodiment.

FIG. 9 is a sectional view of a variable displacement pump according to a third embodiment.

In the third embodiment, the drain hole 28*b* of the first low pressure chamber 281 of the first embodiment is removed, and a first pressure chamber 282 that holds the discharge pressure is formed on the second side surface 6*e* of the cam ring 6, also, a first introduction groove 82 that is open on the second side surface 6*e*, connects the discharge port 26 and the first pressure chamber 282 and introduces the pump discharge pressure into the first pressure chamber 282 is formed on the second side surface 6*e* of the cam ring 6. The first introduction groove 82 is provided at a substantially middle position between the pivot pin 15 and the sealing unit 9. However, the position where the first introduction groove 82 is formed is not limited to the substantially middle position, but could be other position between the pivot pin 15 and the sealing unit 9, for instance, a position on the sealing unit 9 side or on the pivot pin 15 side. The first introduction groove 82 communicates with an arc-shaped arc groove recess portion 43 formed at an inner edge portion of the second side surface 6*e* of the cam ring 6. The arc groove recess portion 43 is provided at a position adjacent to the discharge port 26 so as to substantially overlap with the discharge port 26 when viewed from a direction orthogonal to the mounting surface 1*b*, and extends along an inner circumference of the cam ring 6. Through these arc groove recess portion 43 and first introduction groove 82, the first pressure chamber 282 and the pump chambers 27 communicate with each other. By this configuration, the oil from the discharge port 26 is introduced into the first pressure chamber 282 through the pump chambers 27, the arc groove recess portion 43 and the first introduction groove 82.

Here, the first introduction groove 82 and the arc groove recess portion 43 are not formed at the cam ring 6, but could be formed on the mounting surface 1*b* of the housing body 1 or the mating surface of the cover member 2.

Effect of Third Embodiment

In the third embodiment, the cam ring 6 has, on the second side surface 6*e* thereof, the first introduction groove 82 and the arc groove recess portion 43 which connect the discharge port 26 and the first pressure chamber 282. Therefore, since the discharge port 26 and the first pressure chamber 282 are same in pressure, as compared with the first embodiment, leakage of the oil from the discharge port 26 into the first pressure chamber 282 is suppressed. Thus, an amount of the oil in each pump chamber 27 can be appropriately maintained, and an operation of the variable displacement pump can be stabilized.

Further, in the first embodiment, in a case where the slight gap 17 between the cam ring 6 and the housing body 1 (the pump accommodating portion 13) and the slight gap 18 between the cam ring 6 and the cover member 2 are large, or in a case where the oil temperature is high, the oil has a tendency to leak into the first low pressure chamber 281.

However, as described above, since the discharge port 26 and the first pressure chamber 282 are same in pressure, an excessive leakage of the oil into the first pressure chamber 282 is suppressed even in such conditions in which the oil tends to leak, and the operation of the variable displacement pump can be stabilized.

Fourth Embodiment

Figure 10:
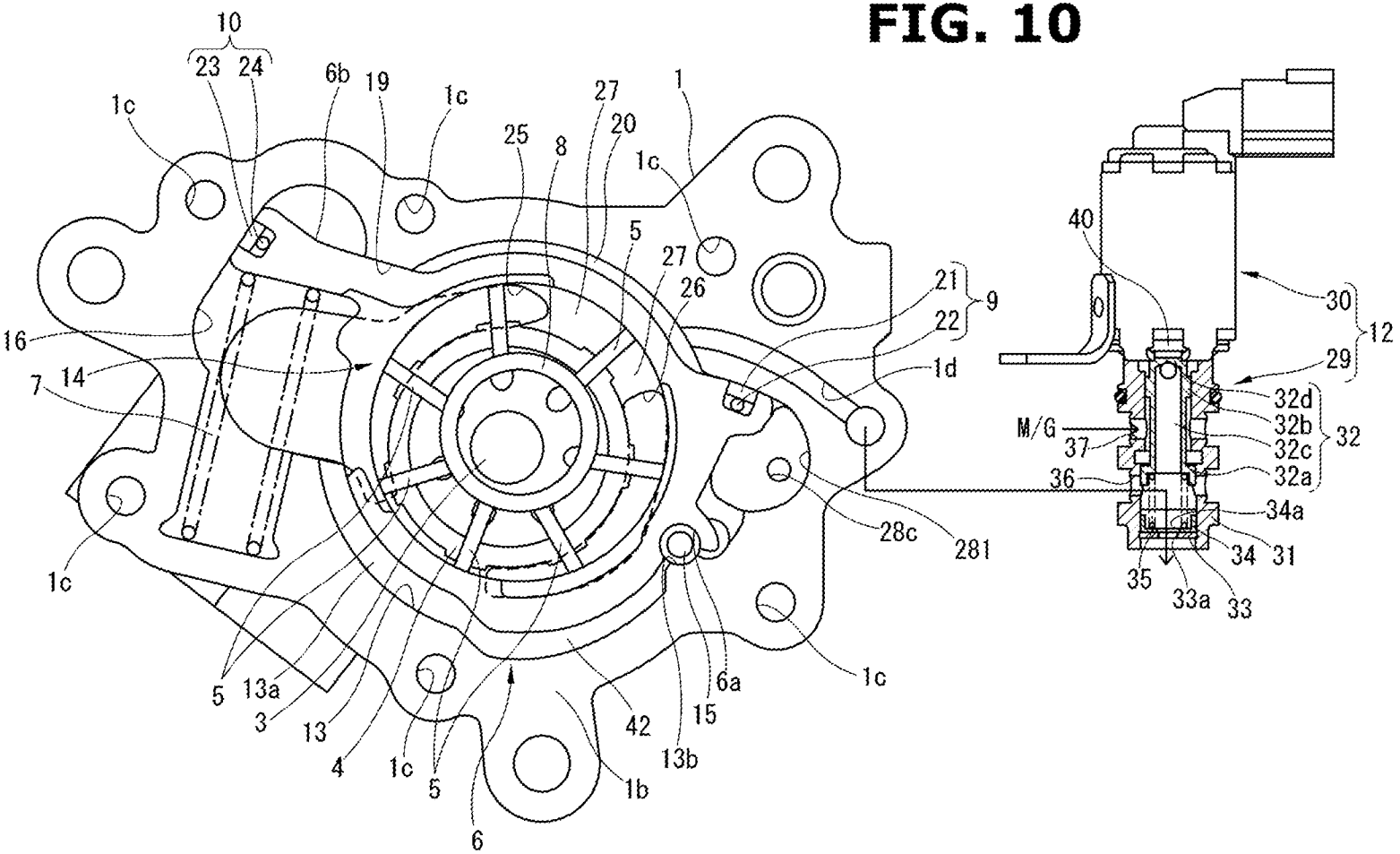
FIG. 10 is a sectional view of a variable displacement pump according to a fourth embodiment.

FIG. 10 is a sectional view of a variable displacement pump according to a fourth embodiment.

In the variable displacement pump of the fourth embodiment, the drain hole 28*b* of the first embodiment is replaced with a main gallery pressure introduction hole 28*c* that communicates with the main oil gallery (M/G). This main gallery pressure introduction hole 28*c* introduces the main gallery pressure P that is lower than the pump discharge pressure into the first low pressure chamber 281 from the main oil gallery (M/G).

Here, the main gallery pressure introduction hole 28*c* is not formed at the housing body 1, but could be formed at the cover member 2.

Effect of Fourth Embodiment

In the fourth embodiment, the main gallery pressure P is introduced into the first low pressure chamber 281 through the main gallery pressure introduction hole 28*c*. Since the main gallery pressure P introduced into the first low pressure chamber 281 is pressure generated by the pump discharge pressure being reduced by passing through an oil filter etc., the main gallery pressure P is lower than the pump discharge pressure. In other words, the discharge port 26 having the pump discharge pressure is higher than the first low pressure chamber 281 having the main gallery pressure P in pressure. Also by such a pressure relationship between the discharge port 26 and the first low pressure chamber 281, the oil leakage from the discharge port 26 into the first low pressure chamber 281 is suppressed. Thus, an amount of the oil in each pump chamber 27 can be appropriately maintained, and the operation of the variable displacement pump can be stabilized.

Fifth Embodiment

Figure 11:
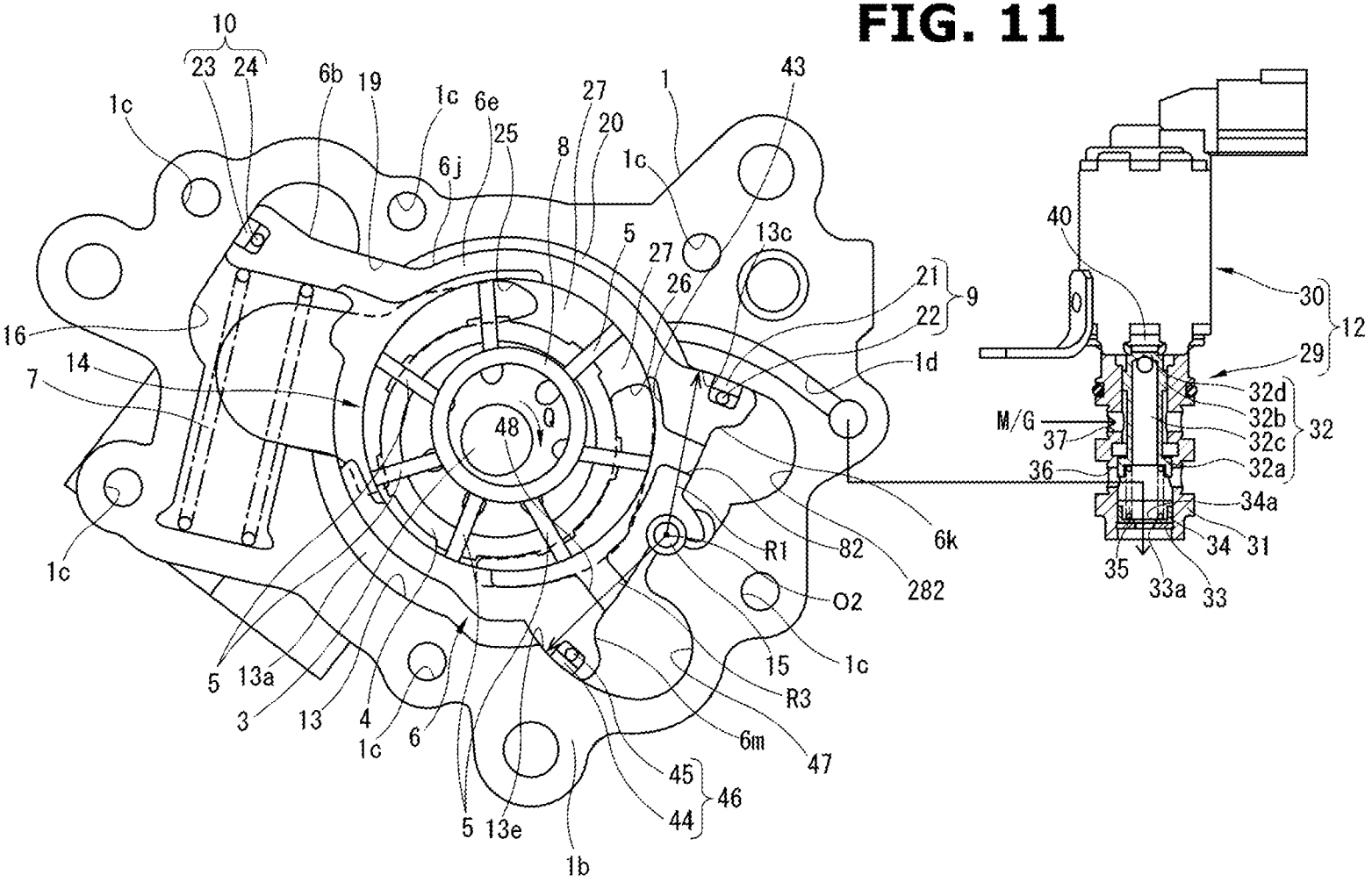
FIG. 11 is a sectional view of a variable displacement pump according to a fifth embodiment.

FIG. 11 is a sectional view of a variable displacement pump according to a fifth embodiment.

In the variable displacement pump of the fifth embodiment, a sealing unit 46 having a seal member 44 and an elastic member 45 is provided in the variable displacement pump of the third embodiment, and a second pressure chamber 47 that is liquid-tightly defined by the sealing unit 46 and the pivot pin 15 is added to the variable displacement pump of the third embodiment.

In the fifth embodiment, on the inner peripheral wall of the pump accommodating portion 13, a third seal contact surface 13*e* which the seal member 44 of the sealing unit 46 contacts is formed at an opposite side to the first seal contact surface 13*c* with respect to the pivot pin 15. As shown in FIG. 11, the third seal contact surface 13*e* is an arc surface formed by a predetermined radius R3 from the center O2 of the pivot pin 15. Here, this radius R3 is set to the substantially same length as the predetermined radius R1 that is a distance from the center O2 of the pivot pin 15 to the first seal contact surface 13*c*.

The second pressure chamber 47 is provided at an opposite side to the first pressure chamber 282 with respect to the pivot pin 15, and is located at a position that overlaps with the discharge port 26 in the radial direction of the pump structure 14.

Further, a second introduction groove 48 that is open on the second side surface 6*e*, connects the discharge port 26 and the second pressure chamber 47 and introduces the pump discharge pressure into the second pressure chamber 47 is formed on the second side surface 6*e* of the cam ring 6. The second introduction groove 48 is provided at a substantially middle position between the pivot pin 15 and the sealing unit 46. However, the position where the second introduction groove 48 is formed is not limited to the substantially middle position, but could be other position between the pivot pin 15 and the sealing unit 46, for instance, a position on the sealing unit 46 side or on the pivot pin 15 side. The second introduction groove 48 communicates with the arc groove recess portion 43 formed on the second side surface 6*e* of the cam ring 6. Through these arc groove recess portion 43 and second introduction groove 48, the second pressure chamber 47 and the pump chambers 27 communicate with each other. By this configuration, the oil from the discharge port 26 is introduced into the second pressure chamber 47 through the pump chambers 27, the arc groove recess portion 43 and the second introduction groove 48.

The outer peripheral surface of the cam ring 6, which faces the second pressure chamber 47, is a pressure receiving surface 6*m* that receives a hydraulic pressure of the second pressure chamber 47. Size of the pressure receiving surface 6*m* is set to such size that a force that rotates the cam ring 6 in the counterclockwise direction in FIG. 11 by a hydraulic pressure of the first pressure chamber 282 acting on the pressure receiving surface 6*k* can be cancelled by a force that rotates the cam ring 6 in the clockwise direction in FIG. 11 by the hydraulic pressure of the second pressure chamber 47 acting on the pressure receiving surface 6*m*.

Here, the first and second introduction grooves 82 and 48 and the arc groove recess portion 43 are not formed on the second side surface 6*e* of the cam ring 6, but could be formed on the mounting surface 1*b* of the housing body 1 or the mating surface of the cover member 2.

More specifically, for instance, by forming the first introduction groove 82 on the second side surface 6*e* of the cam ring 6 and forming the second introduction groove 48 on the mounting surface 1*b* of the housing body 1 or the mating surface of the cover member 2, the first pressure chamber 282 and the second pressure chamber 47 could be connected to each other.

Effect of Fifth Embodiment

In the fifth embodiment, the pump accommodating portion 13 has the second pressure chamber 47 provided at the opposite side to the first pressure chamber 282 with respect to the pivot pin 15. In the variable displacement pump having such first and second pressure chambers 282 and 47, the force that rotates the cam ring 6 in the counterclockwise direction in FIG. 11 by a pump discharge pressure in the first pressure chamber 282 acting on the pressure receiving surface 6*k* is cancelled by the force that rotates the cam ring 6 in the clockwise direction in FIG. 11 by a pump discharge pressure in the second pressure chamber 47 acting on the pressure receiving surface 6*m*. In this manner, an urging force generated by the pump discharge pressure acting on the pressure receiving surface 6*m* acts to assist the urging force of the first coil spring 7. As a result, it is possible to set the set load W1 of the first coil spring 7 to be small.

More specifically, in the third embodiment, there is a need to set the set load W1 of the first coil spring 7 against a resultant force of a force by the pump discharge pressure in the first pressure chamber 282 acting on the pressure receiving surface 6*k* and a force by a hydraulic pressure of the control hydraulic chamber 20 acting on the pressure receiving surface 6*j*.

However, in the fifth embodiment, since the force acting on the pressure receiving surface 6*k* and the force acting on the pressure receiving surface 6*m* are cancelled, the set load W1 of the first coil spring 7 can be set against the force by the hydraulic pressure of the control hydraulic chamber 20 acting on the pressure receiving surface 6*j*. Therefore, as compared with the third embodiment, it is possible to set the set load W1 of the first coil spring 7 to be small. Cost of the first coil spring 7 can thus be reduced.

Further, since the force by the pump discharge pressure in the first pressure chamber 282 acting on the pressure receiving surface 6*k* and the force by the pump discharge pressure in the second pressure chamber 47 acting on the pressure receiving surface 6*m* are balanced, an attitude of the cam ring 6 with respect to the housing body 1 is stabilized. It is therefore possible to suppress vibration of the cam ring 6 due to discharge pulse pressure of the variable displacement pump and suppress noise due to the vibration.

Sixth Embodiment

Figure 12:
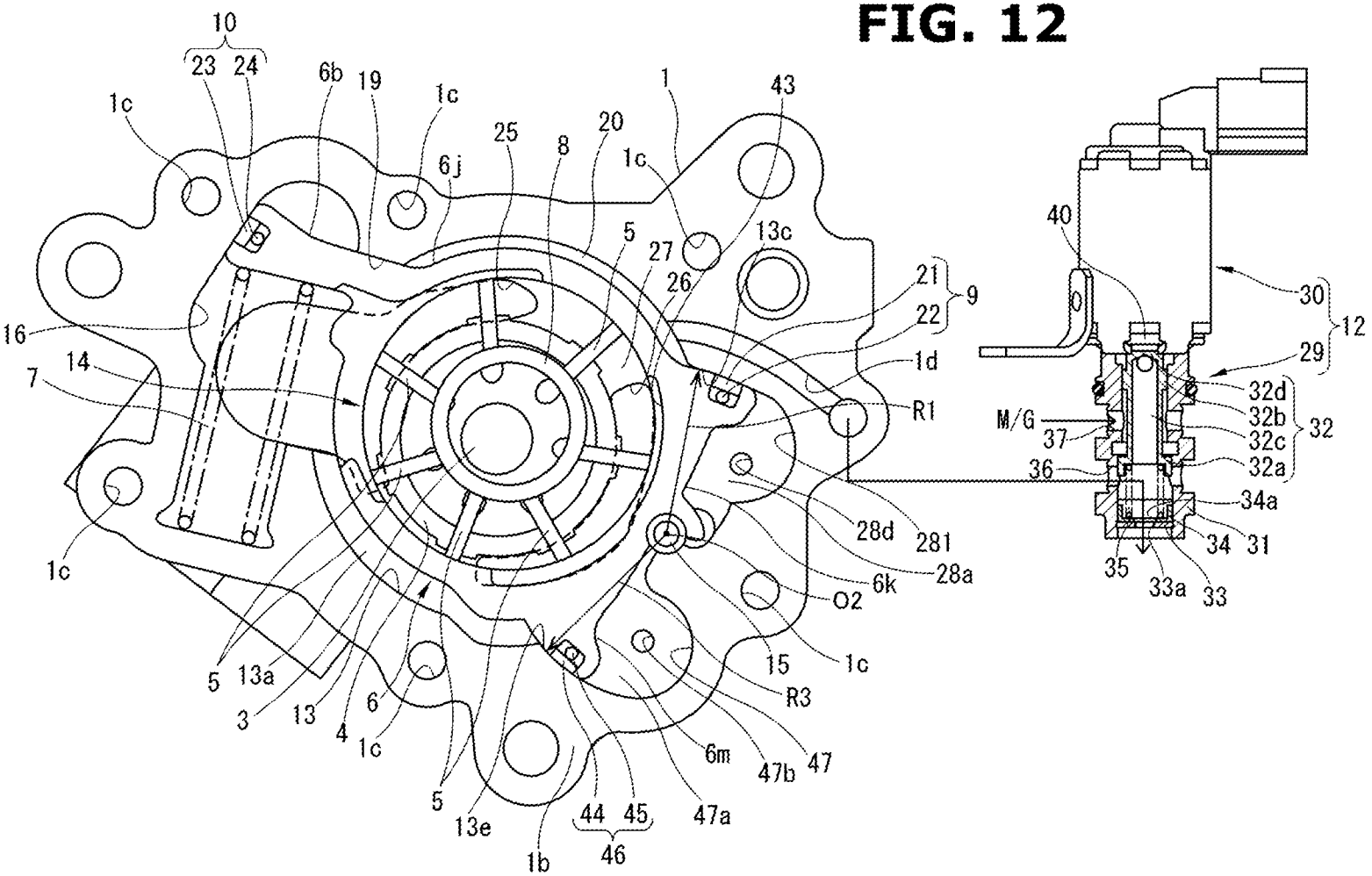
FIG. 12 is a sectional view of a variable displacement pump according to a sixth embodiment.

FIG. 12 is a sectional view of a variable displacement pump according to a sixth embodiment.

In the sixth embodiment, the first and second introduction grooves 82 and 48 of the fifth embodiment are removed, and first and second main gallery pressure introduction holes 28*d* and 47*b* that introduce the main gallery pressure P that is lower than the pump discharge pressure are formed at substantially middle portions on bottom surfaces 28*a* and 47*a* of the first and second low pressure chambers 281 and 47 respectively.

However, the first and second main gallery pressure introduction holes 28*d* and 47*b* are not necessarily formed at the substantially middle portions on the bottom surfaces 28*a* and 47*a*, but could be formed at other positions on the bottom surfaces 28*a* and 47*a*.

Further, the first and second main gallery pressure introduction holes 28*d* and 47*b* are not formed at the housing body 1, but could be formed at the cover member 2.

Furthermore, the main gallery pressure introduction hole could be formed on one of the bottom surface 28*a* of the first low pressure chamber 281 and the bottom surface 47*a* of the second low pressure chamber 47, and another main gallery pressure introduction hole that communicates with the other of the first and second low pressure chambers 281 and 47 could be formed at the cover member 2.

Effect of Sixth Embodiment

The sixth embodiment has the same effect as the fifth embodiment. That is, by the sixth embodiment, the set load W1 of the first coil spring 7 can be set to be small, and cost of the first coil spring 7 can be reduced. In addition, vibration of the cam ring 6 due to discharge pulse pressure of the variable displacement pump can be suppressed, and noise due to the vibration can be suppressed.

Seventh Embodiment

Figure 13:
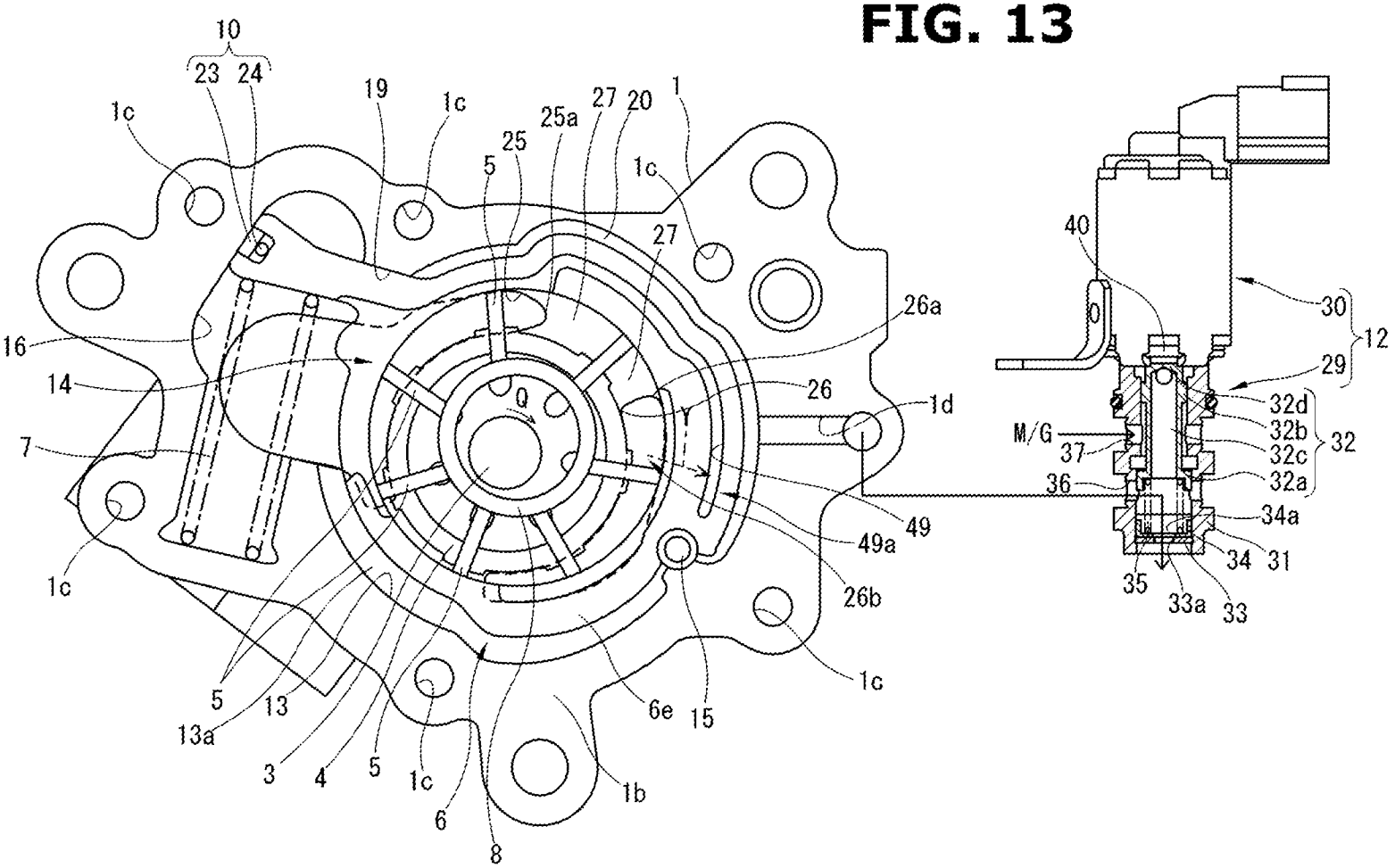
FIG. 13 is a sectional view of a variable displacement pump according to a seventh embodiment.

FIG. 13 is a sectional view of a variable displacement pump according to a seventh embodiment.

In the seventh embodiment, the sealing unit 9 and the first low pressure chamber 281 of the first embodiment are removed, and a groove portion 49 that returns oil, which attempts to leak into the control hydraulic chamber 20 from the discharge port 26, to the suction port 25 is formed on the second side surface 6*e* of the cam ring 6.

In the present embodiment, as shown in FIG. 13, the control hydraulic chamber 20 sealed by the pivot pin 15 and the sealing unit 10 is defined in an outer peripheral region of the cam ring 6.

The groove portion 49 is provided substantially along the rotation direction Q of the pump structure 14, and communicates with the pump chambers 27 facing the suction port 25. That is, the groove portion 49 extends in a substantially arc shape at a substantially middle position of a radial direction width of the cam ring 6 from a vicinity of the pivot pin 15 toward a vicinity of an end 25*a* of the suction port 25 in the counterclockwise direction in FIG. 13, and communicates with the pump chambers 27 in the suction region. A region 49*a* that is a part of the groove portion 49 on the pivot pin 15 side is provided between the discharge port 26 and the inner peripheral surface of the pump accommodating portion 13 so as to overlap with a region 26*b* that is a part of the discharge port 26 on a base end 26*a* side thereof in the radial direction of the pump structure 14. The oil in the discharge port 26 flows into the region 49*a* of the groove portion 49 (see an arrow Y of a broken line in FIG. 13) through the pump chambers 27 and the slight gap (see FIG. 2) between the second side surface 6*e* of the cam ring 6 and the cover member 2. Afterwards, the oil flowing into the region 49*a* is guided to the pump chambers 27 in the suction region through the groove portion 49, and is returned to the suction port 25 through the pump chambers 27.

Here, the groove portion 49 is not formed on the second side surface 6*e* of the cam ring 6, but could be formed on the mating surface of the cover member 2.

Effect of Seventh Embodiment

In the seventh embodiment, the groove portion 49 is provided along the rotation direction Q of the pump structure 14, and communicates with the pump chambers 27 facing the suction port 25. By this configuration, the oil attempting to leak into the control hydraulic chamber 20 from the discharge port 26 is returned to the suction port 25 through the groove portion 49 and the pump chambers 27 facing the suction port 25. Therefore, the oil leakage from the discharge port 26 into the control hydraulic chamber 20 is suppressed. The early operation (or the early action) of the cam ring 6 due to the oil leaking into the control hydraulic chamber 20 is thus suppressed, and the desired oil can be supplied to the internal combustion engine.

Further, in the present embodiment, the oil leaking from the discharge port 26 is directly returned to the suction port 25. Therefore, since there is no need to drain the oil in the first low pressure chamber 281 to the oil pan and to supply the oil to the suction port 25 again through the oil strainer, it is possible to improve efficiency of the variable displacement pump.

Eighth Embodiment

Figure 14:
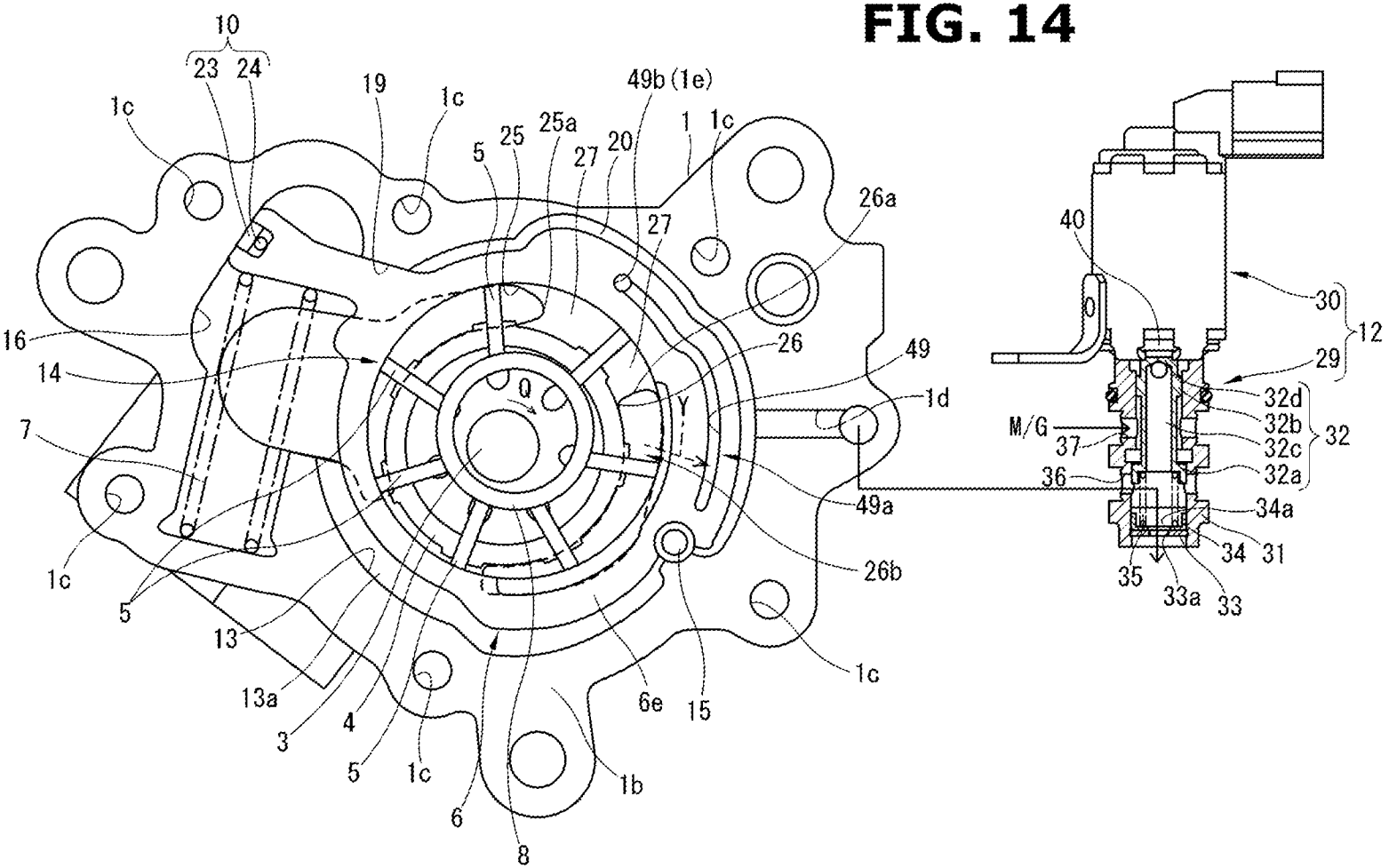
FIG. 14 is a sectional view of a variable displacement pump according to an eighth embodiment.

FIG. 14 is a sectional view of a variable displacement pump according to an eighth embodiment.

In the eighth embodiment, the groove portion 49 communicates with the oil pan through a hole portion 49*b* provided at the groove portion 49 and a penetration hole 1*e* formed inside the housing body 1. That is, in the eighth embodiment, the groove portion 49 of the seventh embodiment does not extend to the vicinity of the end 25*a* of the suction port 25 and is closed, but the groove portion 49 of the eighth embodiment communicates with the oil pan through the hole portion 49*b* formed at an end portion, which is opposite side to the pivot pin 15, of a bottom portion of the groove portion 49 by penetrating the bottom portion of the groove portion 49 and through the penetration hole 1*e* formed on the bottom surface 13*a* of the pump accommodating portion 13 by penetrating the bottom surface 13*a*. However, the hole portion 49*b* is not formed at the end portion that is opposite side to the pivot pin 15, but could be formed at other position on the groove portion 49. The oil in the discharge port 26 flows into the region 49*a* of the groove portion 49 (see an arrow Y of a broken line in FIG. 14) through the pump chambers 27 and the slight gap 18 (see FIG. 2) between the second side surface 6*e* of the cam ring 6 and the cover member 2. Afterwards, the oil flowing into the region 49*a* is returned to the oil pan through the groove portion 49, the hole portion 49*b* and the penetration hole 1*e*.

Here, the penetration hole 1*e* is not formed on the bottom surface 13*a* of the pump accommodating portion 13, but could be formed at the cover member 2.

Effect of Eighth Embodiment

In the eighth embodiment, the groove portion 49 communicates with the oil pan through the hole portion 49*b* formed at the groove portion 49 and the penetration hole 1*e* of the housing body 1. By this configuration, the oil attempting to leak into the control hydraulic chamber 20 from the discharge port 26 is returned to the oil pan through the groove portion 49, the hole portion 49*b* and the penetration hole 1*e*, then the oil leakage from the discharge port 26 into the control hydraulic chamber 20 is suppressed. The early operation (or the early action) of the cam ring 6 due to the oil leaking into the control hydraulic chamber 20 is thus suppressed, and the desired oil can be supplied to the internal combustion engine.

Ninth Embodiment

Figure 15:
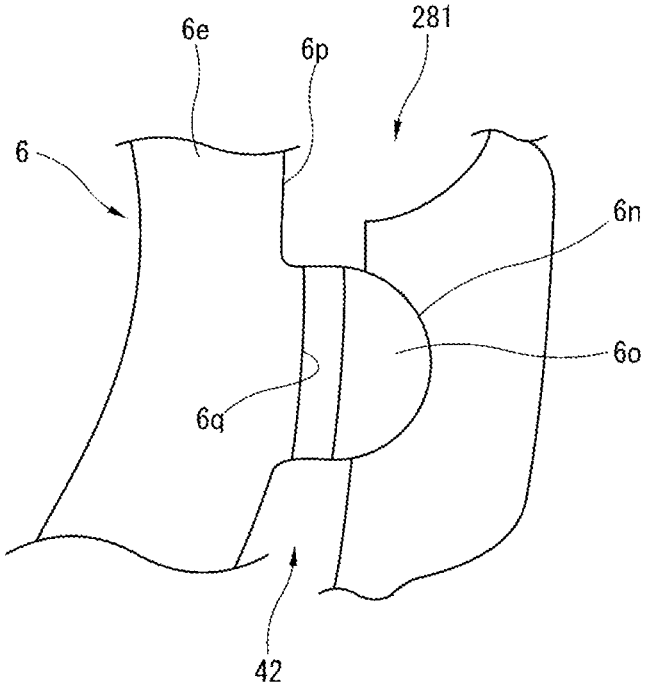
FIG. 15 is a sectional view of a variable displacement pump according to a ninth embodiment.

FIG. 15 is a sectional view of a variable displacement pump according to a ninth embodiment.

In the ninth embodiment, the pivot pin 15 and the cam ring 6 of the first to eighth embodiments are formed integrally with each other, and the cam ring 6 has a pivot portion 6*n* that protrudes in an arc shape from the outer peripheral surface of the cam ring 6. This pivot portion 6*n* has a pivot portion side surface 6*o* that continues to the second side surface 6*e* of the cam ring 6. A communication recess portion 6*q* as a suction portion returning passage is formed so as to be open on the pivot portion side surface 6*o* at a position on an outer peripheral surface 6*p* side of the cam ring 6. Through the communication recess portion 6*q*, the first low pressure chamber 281 and the space 42 located at an opposite side to the first low pressure chamber 281 with respect to the pivot portion 6*n* communicate with each other. The oil in the first low pressure chamber 281 flows into the space 42 through the communication recess portion 6*q*, and is returned to the suction port (not shown).

Here, the communication recess portion 6*q* could be formed on a pivot portion side surface (not shown) that is on an opposite side to the pivot portion side surface 6*o*. Further, the communication recess portions 6*q* may be formed at both of the pivot portion side surface 6*o* and the above opposite-side pivot portion side surface.

Effect of Ninth Embodiment

In the ninth embodiment, the communication recess portion 6*q* through which the first low pressure chamber 281 and the space 42 communicate with each other is formed at the pivot portion 6*n* of the cam ring 6. By forming the communication recess portion 6*q* at the pivot portion 6*n* as described above, as compared with the case where the suction portion returning passage 41 is formed on the mounting surface 1*b* of the housing body 1 like the second embodiment, size reduction of the variable displacement pump is possible.

More specifically, if the suction portion returning passage 41 is formed so as to bypass the pivot pin 15 like the second embodiment, this requires securing a thickness of the housing body 1 by an amount of the bypass, and consequently, size of the variable displacement pump may be increased in the radial direction of the pump structure 14.

However, by forming the relatively short communication recess portion 6*q* at the pivot portion 6*n* located between the first low pressure chamber 281 and the space 42 like the present embodiment, there is no need to secure the thickness of the housing body 1, and the size of the variable displacement pump can be decreased.

Tenth Embodiment

Figure 16:
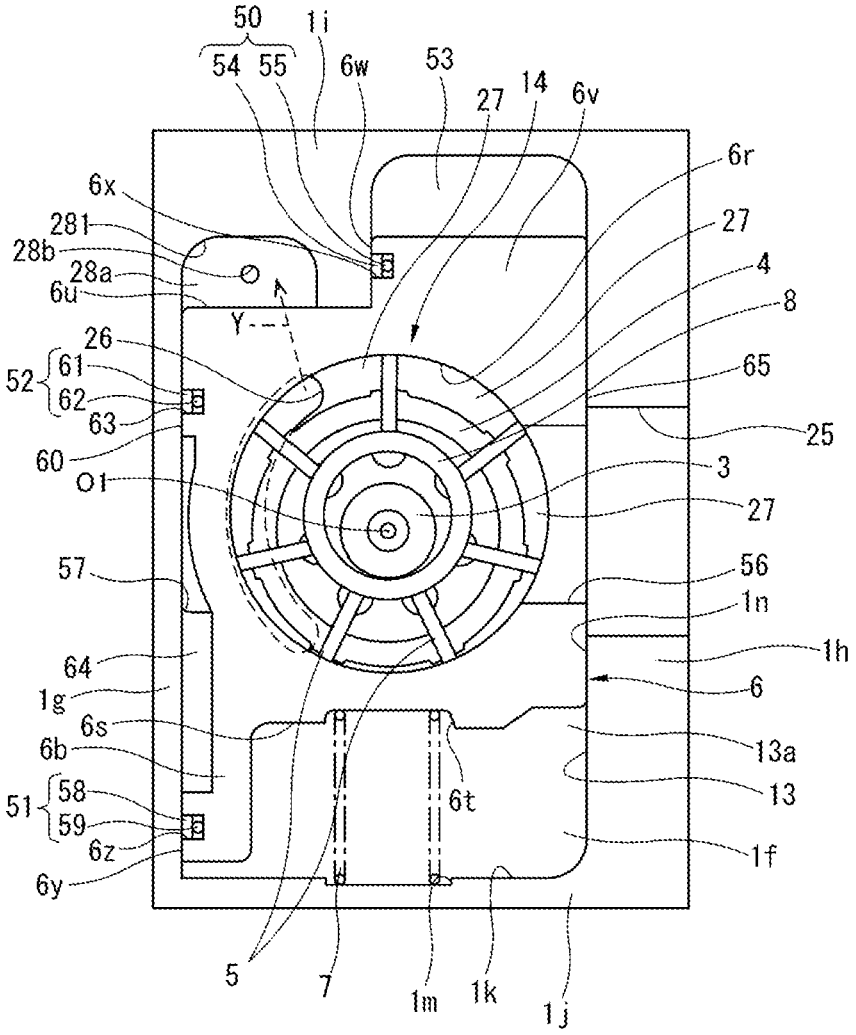
FIG. 16 is a sectional view of a variable displacement pump according to a tenth embodiment.

FIG. 16 is a sectional view of a variable displacement pump according to a tenth embodiment.

The variable displacement pump of the tenth embodiment is different from the variable displacement pumps of the first to ninth embodiments, and is a type of variable displacement pump in which a cam ring 6 is slidable.

The variable displacement pump has a housing body 1, the driving shaft 3, the rotor 4, the seven vanes 5 and the pair of ring members 8 which are structured in the same manner as the first to ninth embodiments, the cam ring 6, a first coil spring 7 and three sealing units 50, 51 and 52.

The housing body 1 is formed as an integral body with metal material, e.g. aluminium alloy material. The housing body 1 is rectangular in shape when viewed from its front. The housing body 1 has a rectangular plate-shaped bottom wall 1*f*, a pair of long walls 1*g* and 1*h* standing from both side edges of this bottom wall if and a pair of short walls 1*i* and 1*j* connecting opposing end portions of the long walls 1*g* and 1*h*. The housing body 1 is formed into a closed-bottomed tubular shape with the housing body 1 enclosed by the bottom wall 1*f*, the long walls 1*g* and 1*h* and the short walls 1*i* and 1*j* so as to have a pump accommodating portion 13 accommodating therein the driving shaft 3 etc. A pump housing defining or partitioning the pump accommodating portion 13 is formed by the housing body 1 with a cover member (not shown) fixed to the housing body 1.

The cam ring 6 (an adjustment ring) is formed into a substantially square tubular shape as an integral ring with sintered metal. The cam ring 6 has, at a middle portion thereof, a circular penetration opening 6*r* formed so as to penetrate the middle portion in an axial direction of the driving shaft 3. The driving shaft 3, the rotor 4 and the vanes 5, which form a pump structure 14, and the pair of ring members 8 are accommodated inside this penetration opening 6*r*. The cam ring 6 is provided movably in a direction (a direction orthogonal to a rotation axis O1 of the pump structure 14) along the long walls 1*g* and 1*h* by balance between a hydraulic pressure of an after-mentioned first control hydraulic chamber 53 provided at the short wall 1*i* side and a spring force of the first coil spring 7 provided at the short wall 1*j* side.

A first circular recess portion 6*t* on which one end of the first coil spring 7 elastically abuts is formed on a first flat surface 6*s*, facing the short wall 1*j*, of the cam ring 6. Between this first circular recess portion 6*t* and a second circular recess portion 1*m* provided on an inner side surface 1*k* of the short wall 1*j*, the first coil spring 7 is installed with a predetermined set load provided.

A rectangular overhanging portion 6*v* overhangs or protrudes from a second flat surface 6*u* of the cam ring 6, which is on an opposite side to the first flat surface 6*s*, toward the short wall 1*i*. The first control hydraulic chamber 53 structured so that oil can be supplied from a solenoid valve (a control valve) (not shown) to the first control hydraulic chamber 53 is provided between the overhanging portion 6*v* and the short wall 1*i*. On a side surface 6*w* on the long wall 1*g* side of the overhanging portion 6*v*, a first seal holding recess groove 6*x* that accommodates therein the sealing unit 50 having a seal member 54 and an elastic member 55 is formed in a direction of the rotation axis O1 of the pump structure 14. The first control hydraulic chamber 53 is sealed by the seal member 54 accommodated in the first seal holding recess groove 6*x*. The hydraulic pressure of the first control hydraulic chamber 53 presses the cam ring 6 to the short wall 1*j* side against the spring force of the first coil spring 7.

A suction communication passage 56 through which a suction port 25 provided at the long wall 1*h* and pump chambers 27 communicate with each other is formed at a portion, facing the long wall 1*h*, of the cam ring 6. Through this suction communication passage 56, oil sucked from the suction port 25 flows into the pump chambers 27 adjacent to the suction communication passage 56.

A discharge port 26 (shown by a solid line and a broken line in FIG. 16) as an arc-recessed discharge portion is formed at a position on the long wall 1*g* side with respect to the driving shaft 3 on the bottom wall if by cutting. The discharge port 26 communicates with an after-mentioned second control hydraulic chamber 64 through a discharge communication passage 57 that is formed on the bottom wall if by cutting in the same manner as the discharge port 26.

An arm portion 6*b* that protrudes to the short wall 1*j* side is formed at a portion, on the long wall 1*g* side, of the first flat surface 6*s* of the cam ring 6. On a first opposing surface 6*y*, facing the long wall 1*g*, of this arm portion 6*b*, a second seal holding recess groove 6*z* that accommodates therein the sealing unit 51 having a seal member 58 and an elastic member 59 is formed in the direction of the rotation axis O1 of the pump structure 14.

Further, on a second opposing surface 60, facing the long wall 1*g*, of the cam ring 6, a third seal holding recess groove 63 that accommodates therein the sealing unit 52 having a seal member 61 and an elastic member 62 is formed in the direction of the rotation axis O1 of the pump structure 14.

The second control hydraulic chamber 64 is liquid-tightly defined in a region facing the long wall 1*g* in an outer peripheral region of the cam ring 6 by the seal members 58 and 61 accommodated in the second and third seal holding recess grooves 6*z* and 63. This second control hydraulic chamber 64 communicates with the pump chambers 27 through the discharge communication passage 57 formed on the bottom wall 1*f*. A pump discharge pressure is introduced into the second control hydraulic chamber 64 through the discharge communication passage 57 communicating with the discharge port 26. Then, the pump discharge pressure in the second control hydraulic chamber 64 presses the cam ring 6 against the long wall 1*h*. That is, a third opposing surface 65, facing the long wall 1*h*, of the cam ring 6 is pressed on an inner side surface 1*n* of the long wall 1*h*, then the first control hydraulic chamber 53 and the suction communication passage 56 of the long wall 1*h* are partitioned. By the balance between the hydraulic pressure of the first control hydraulic chamber 53 and the spring force of the first coil spring 7, the third opposing surface 65 of the cam ring 6 is in sliding contact with the inner side surface 1*n* of the long wall 1*h* when the cam ring 6 moves along the long walls 1*g* and 1*h*.

Further, a first low pressure chamber 281 is liquid-tightly defined at a position facing the second flat surface 6*u* of the cam ring 6 at the short wall 1*i* by the seal members 54 and 61 accommodated in the first and third seal holding recess grooves 6*x* and 63. This first low pressure chamber 281 is provided at a position that overlaps with the discharge port 26 in a direction parallel to the long walls 1*g* and 1*h*. A drain hole 28*b* that communicates with a low pressure portion located outside the housing body 1 is formed on a bottom surface 28*a* of the first low pressure chamber 281 by penetrating the bottom surface 28*a* along the direction of the rotation axis O1 of the pump structure 14. The low pressure portion has pressure that is equal to or less than a hydraulic pressure of the oil discharged from the discharge port 26. More specifically, in the present embodiment, the drain hole 28*b* is connected to an oil pan, and the first low pressure chamber 281 has atmospheric pressure. By this configuration, the oil from the pump chambers 27, whose pressure is higher than that in the first low pressure chamber 281, flows into the first low pressure chamber 281 communicating with the low pressure portion by a pressure difference between the pump chambers 27 and the first low pressure chamber 281 through a slight gap (not shown) between the cam ring 6 and a bottom surface 13*a* of the pump accommodating portion 13 and a slight gap (not shown) between the cam ring 6 and the cover member (not shown) (see an arrow Y of a broken line in FIG. 16). The oil flowing into the first low pressure chamber 281 is drained to the oil pan (not shown) through the drain hole 28*b*.

In such a variable displacement pump, when oil is supplied to the first control hydraulic chamber 53 by the solenoid valve and the hydraulic pressure of the first control hydraulic chamber 53 becomes high, the hydraulic pressure of the first control hydraulic chamber 53 presses the cam ring 6 to the short wall 1*j* side against the spring force of the first coil spring 7. On the other hand, when the oil in the first control hydraulic chamber 53 is drained by the solenoid valve and the hydraulic pressure of the first control hydraulic chamber 53 becomes low, the first coil spring 7 forces the cam ring 6 to the short wall 1*i* side by the spring force of the first coil spring 7 against the hydraulic pressure of the first control hydraulic chamber 53.

Effect of Tenth Embodiment

In the tenth embodiment, the cam ring 6 is provided movably in the direction along the long walls 1*g* and 1*h*. Further, in the variable displacement pump having this cam ring 6, the first low pressure chamber 281 is provided at the position that overlaps with the discharge port 26 in the direction parallel to the long walls 1*g* and 1*h*. Therefore, also in the variable displacement pump configured in this manner, the oil in the discharge port 26 flows into the first low pressure chamber 281 by a pressure difference between the discharge port 26 and the first low pressure chamber 281 through the slight gap (not shown) between the cam ring 6 and the bottom surface 13*a* of the pump accommodating portion 13 and the slight gap (not shown) between the cam ring 6 and the cover member (not shown). Thus, the oil leakage from the discharge port 26 into the first control hydraulic chamber 53 is suppressed. An early operation (or an early action) of the cam ring 6 due to the oil leaking into the first control hydraulic chamber 53 is therefore suppressed, and desired oil can be supplied to the internal combustion engine.

Eleventh Embodiment

Figure 17:
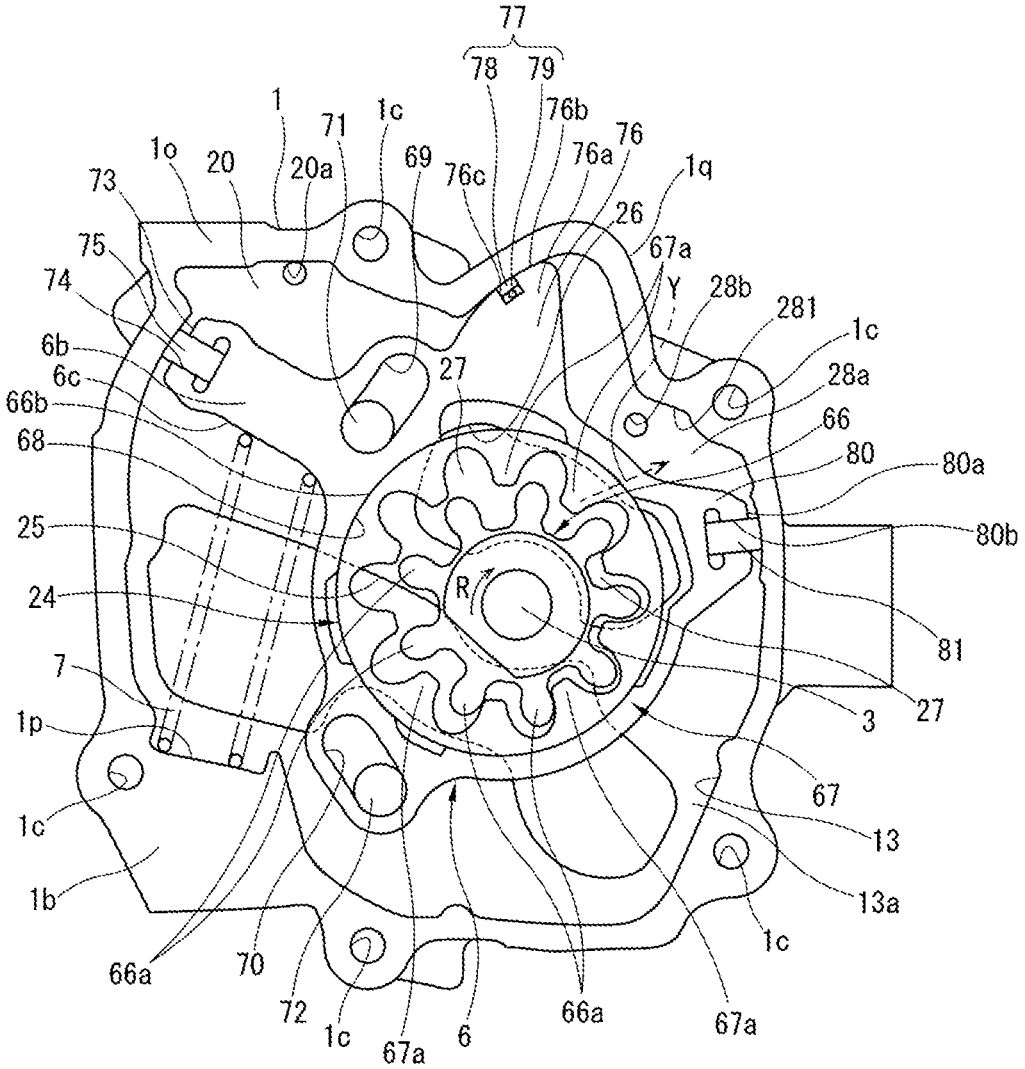
FIG. 17 is a sectional view of a variable displacement pump according to an eleventh embodiment.

FIG. 17 is a sectional view of a variable displacement pump according to an eleventh embodiment.

The variable displacement pump of the eleventh embodiment is different from the variable displacement pumps of the first to tenth embodiments, and is a trochoid-type variable displacement pump.

The variable displacement pump has a housing body 1, a driving shaft 3, an inner rotor 66, an outer rotor 67, a cam ring 6, a first coil spring 7 and three sealing units 75, 77 and 81.

The housing body 1 is formed into a closed-bottomed tubular shape with metal material, e.g. aluminium alloy material. A pump accommodating portion 13 accommodating therein the driving shaft 3 etc. is provided at an inner side of a peripheral wall 1*o* that surrounds the housing body 1. The housing body 1 is provided with an annularly-continuous flat mounting surface 1*b* for mounting a cover member (not shown) at an outer peripheral side of an opening of the pump accommodating portion 13. Five screw holes 1*c* into which respective screw members (not shown) are screwed are formed on this mounting surface 1*b*.

A pump housing defining or partitioning the pump accommodating portion 13 is formed by the housing body 1 and the cover member.

As shown in FIG. 17, on a bottom surface 13*a* of the pump accommodating portion 13, a suction port 25 (shown by a solid line and a broken line in FIG. 17) and a discharge port 26 (shown by a solid line and a broken line in FIG. 17) as a substantially arc-recessed discharge portion are formed by cutting so as to face each other with respect to the driving shaft 3 in a periphery of the driving shaft 3.

The driving shaft 3 penetrates a substantially center part of the pump accommodating portion 13, and is rotatably supported by the pump housing. The driving shaft 3 is driven and rotated by a crankshaft (not shown). The driving shaft 3 rotates the inner rotor 66 in a rotation direction R of the driving shaft 3, i.e. in a clockwise direction in FIG. 17, by rotational force transmitted from the crankshaft.

The inner rotor 66 is substantially cylindrical in shape, and a center portion of the inner rotor 66 is connected to the driving shaft 3. The inner rotor 66 is provided with a plurality of external tooth 66*a* (in the present embodiment, nine tooth) at an outer circumference of the inner rotor 66.

The outer rotor 67 has a substantially cylindrical shape whose outside diameter is greater than that of the inner rotor 66. A rotation center of the outer rotor 67 is eccentric to a rotation center of the inner rotor 66. The outer rotor 67 is provided with a plurality of internal tooth 67*a* (in the present embodiment, ten tooth) whose number is greater than that of the tooth 66*a* of the inner rotor 66 by one at an inner circumference of the outer rotor 67. As shown in FIG. 17, several internal tooth 67*a* (in the present embodiment, five tooth), which are adjacent in a circumferential direction, of the ten internal tooth 67*a* of the outer rotor 67 mesh with several external tooth 66*a* (in the present embodiment, four tooth), which are adjacent in a circumferential direction, of the external tooth 66*a* of the inner rotor 66 with the outer rotor 67 being eccentric to the inner rotor 66.

The pump chambers 27 filled with the oil are defined between the outer rotor 67 and the inner rotor 66. The suction port 25 is open in a region (a suction region) where an internal volume of each pump chamber 27 increases according to pumping rotation of the inner rotor 66. On other hand, the discharge port 26 is open in a region (a discharge region) where the internal volume of each pump chamber 27 decreases according to pumping rotation of the inner rotor 66.

The driving shaft 3, the inner rotor 66 and the outer rotor 67 form a pump structure 14.

The cam ring 6 (an adjustment ring) is formed into a substantially cylindrical shape as an integral ring with sintered metal. The cam ring 6 has an inner circumferential surface 68 that substantially corresponds to the outside diameter of the outer rotor 67, and an outer circumferential surface 66*b* of the outer rotor 67 is held by the inner circumferential surface 68. At predetermined two positions on a side surface of the cam ring 6, long holes 69 and 70 extending in specified directions respectively are formed by penetrating the cam ring 6 along an axial direction of the driving shaft 3. First and second pivot pins 71 and 72 supported by the bottom surface 13*a* of the pump accommodating portion 13 penetrate or are inserted into these long holes 69 and 70 respectively. The cam ring 6 is movable along longitudinal directions of the long holes 69 and 70 while being guided by the first and second pivot pins 71 and 72.

An arm portion 6*b* linked to the first coil spring 7 protrudes from an outer peripheral surface of the cam ring 6 in a radially outward direction of the cam ring 6. A contact portion 6*c* of the arm portion 6*b*, which faces the first coil spring 7, is always in contact with a top end portion of the first coil spring 7, then the arm portion 6*b* and the first coil spring 7 are linked to each other. A first seal groove 74 that is recessed on a top end surface 73 of the arm portion 6*b* is formed on the top end surface 73 along the axial direction of the driving shaft 3. The sealing unit 75 sealing a gap between the top end surface 73 and an inner peripheral surface of the pump accommodating portion 13 is provided in the first seal groove 74.

The first coil spring 7 is provided with a predetermined set load, and elastically abuts on a flat portion 1*p* provided at the housing body 1 and the contact portion 6*c* of the arm portion 6*b*.

The cam ring 6 has, at a position close to the long hole 69, a first seal holding protruding portion 76 that protrudes outwards in the radial direction of the cam ring 6 from an outer peripheral portion of the cam ring 6. This first seal holding protruding portion 76 has a substantially triangular plate shape, and a portion on a top 76*a* side is located inside a bulging portion 1*q* that bulges outwards from the peripheral wall of the housing body 1. On an inclined surface 76*b* of the first seal holding protruding portion 76 on the arm portion 6*b* side, a second seal groove 76*c* that is recessed on the inclined surface 76*b* is formed at a position on the top 76*a* side along the axial direction of the driving shaft 3. The sealing unit 77 sealing the inclined surface 76*b* and an inner surface of the bulging portion 1*q* is provided in this second seal groove 76*c*. The sealing unit 77 has a seal member 78 and an elastic member 79 that presses the seal member 78 against the inner surface of the bulging portion 1*q*. The sealing unit 77 partitions or defines a space between the cam ring 6 and the housing body 1 in cooperation with the sealing unit 75 provided at a top end portion of the arm portion 6*b*. A control hydraulic chamber 20 is then liquid-tightly defined between the outer peripheral surface of the cam ring 6 and an inner peripheral surface of the housing body 1. A hole portion 20*a* is formed on a bottom surface of the control hydraulic chamber 20 by penetrating the bottom surface of the control hydraulic chamber 20, and oil can be supplied to the control hydraulic chamber 20 from a solenoid valve (a control valve) (not shown) through this hole portion 20*a*.

The cam ring 6 further has, at a position that is separate from the first seal holding protruding portion 76 in the rotation direction R of the driving shaft 3 by a predetermined distance, a second seal holding protruding portion 80 that protrudes outwards in the radial direction of the cam ring 6 from the outer peripheral portion of the cam ring 6. On a radial direction end surface 80*a* of the second seal holding protruding portion 80, a third seal groove 80*b* that is recessed on the radial direction end surface 80*a* is formed along the axial direction of the driving shaft 3. The sealing unit 81 sealing the radial direction end surface 80*a* and the inner peripheral surface of the pump accommodating portion 13 is provided in the third seal groove 80*b*. The sealing unit 81 partitions or defines a space between the cam ring 6 and the housing body 1 in cooperation with the sealing unit 77 provided at the first seal holding protruding portion 76. A first low pressure chamber 281 is then liquid-tightly defined between the outer peripheral surface of the cam ring 6 and the inner peripheral surface of the housing body 1.

The first low pressure chamber 281 is provided at a position that overlaps with the discharge port 26 in a radial direction of the pump structure 14 formed by the driving shaft 3, the inner rotor 66 and the outer rotor 67. A drain hole 28*b* that communicates with a low pressure portion located outside the housing body 1 is formed on a bottom surface 28*a* of the first low pressure chamber 281 by penetrating the bottom surface 28*a* along the axial direction of the driving shaft 3. The low pressure portion has pressure that is equal to or less than a hydraulic pressure of the oil discharged from the discharge port 26. More specifically, in the present embodiment, the drain hole 28*b* is connected to an oil pan, and the first low pressure chamber 281 has atmospheric pressure. By this configuration, the oil from the pump chambers 27, whose pressure is higher than that in the first low pressure chamber 281, flows into the first low pressure chamber 281 communicating with the low pressure portion by a pressure difference between the pump chambers 27 and the first low pressure chamber 281 through a slight gap between the cam ring 6 and the bottom surface 13*a* of the pump accommodating portion 13 and a slight gap between the cam ring 6 and the cover member (not shown) (see an arrow Y of a broken line in FIG. 17). The oil flowing into the first low pressure chamber 281 is drained to the oil pan (not shown) through the drain hole 28*b*.

By the above configuration, in the variable displacement pump according to the present embodiment, when oil is supplied to the control hydraulic chamber 20 by the solenoid valve and a hydraulic pressure of the control hydraulic chamber 20 becomes high, the hydraulic pressure of the control hydraulic chamber 20 moves the arm portion 6*b* of the cam ring 6 in the counterclockwise direction in FIG. 17 against a spring force of the first coil spring 7. On the other hand, the oil in the control hydraulic chamber 20 is drained by the solenoid valve and the hydraulic pressure of the control hydraulic chamber 20 becomes low, the first coil spring 7 moves the arm portion 6*b* of the cam ring 6 in the clockwise direction in FIG. 17 by the spring force of the first coil spring 7 against the hydraulic pressure of the control hydraulic chamber 20.

Effect of Eleventh Embodiment

In the eleventh embodiment, the pump structure 14 has the inner rotor 66 having the plurality of external tooth 66*a* at the outer circumference of the inner rotor 66 and the outer rotor 67 located at an outer peripheral side with respect to the inner rotor 66 and having the plurality of internal tooth 67*a* meshing with the plurality of external tooth 66*a* at the inner circumference of the outer rotor 67. Further, in the variable displacement pump having these inner rotor 66 and outer rotor 67, the first low pressure chamber 281 overlaps with the discharge port 26 in the radial direction of the pump structure 14. Therefore, the oil in the discharge port 26 flows into the first low pressure chamber 281 by a pressure difference between the discharge port 26 and the first low pressure chamber 281 through the slight gap (not shown) between the cam ring 6 and the bottom surface 13*a* of the pump accommodating portion 13 and the slight gap (not shown) between the cam ring 6 and the cover member (not shown). Thus, the oil leakage from the discharge port 26 into the control hydraulic chamber 20 is suppressed. The early operation (or the early action) of the cam ring 6 due to the oil leaking into the control hydraulic chamber 20 is therefore suppressed, and the desired oil can be supplied to the internal combustion engine.

As the variable displacement pump based on the embodiments described above, for instance, the following aspects can be raised.

As one aspect of the present invention, a variable displacement pump comprises: a pump housing having a pump accommodating portion, a suction portion and a discharge portion, each of which is open at the pump accommodating portion; an adjustment ring movably provided in the pump accommodating portion; a pump structure provided inside the adjustment ring and discharging oil, which is sucked from the suction portion, from the discharge portion by being driven and rotated, wherein a flow amount of the oil discharged from the discharge portion by the pump structure is changed when the adjustment ring moves; a control hydraulic chamber provided between the pump accommodating portion and the adjustment ring in a radial direction of the pump structure with respect to a rotation axis of the pump structure and forcing the adjustment ring in a direction in which the flow amount of the oil discharged from the discharge portion decreases when a control pressure is introduced into the control hydraulic chamber; a control valve controlling pressure of oil in the control hydraulic chamber; and a first low pressure chamber provided at a position that overlaps with the discharge portion between the pump accommodating portion and the adjustment ring in the radial direction of the pump structure with respect to the rotation axis of the pump structure and communicating with a low pressure portion that has pressure that is equal to or less than a hydraulic pressure of the oil discharged from the discharge portion.

As a preferable aspect of the variable displacement pump, the low pressure portion has atmospheric pressure, and the first low pressure chamber is provided with a drain hole that communicates with an external portion of the pump housing, and the atmospheric pressure is introduced into the first low pressure chamber through the drain hole.

As another preferable aspect, in any aspect of the variable displacement pump, the pump accommodating portion has a pivot portion provided so as to be adjacent to the first low pressure chamber in a rotation direction of the pump structure, and the adjustment ring pivots on the pivot portion.

As another preferable aspect, in any aspect of the variable displacement pump, the low pressure portion is the suction portion, and the first low pressure chamber communicates with the low pressure portion through a suction portion returning passage provided at the pump housing.

As another preferable aspect, in any aspect of the variable displacement pump, the suction portion returning passage is provided at an outer peripheral side with respect to the adjustment ring in the radial direction of the pump structure with respect to the rotation axis of the pump structure.

As another preferable aspect, in any aspect of the variable displacement pump, the suction portion returning passage is formed at the adjustment ring.

As another preferable aspect, in any aspect of the variable displacement pump, the pump housing is formed by combination of a first housing and a second housing, and the suction portion returning passage is a groove that is open on a mating surface of the first housing and the second housing.

As another preferable aspect, in any aspect of the variable displacement pump, a main gallery pressure is introduced into the first low pressure chamber.

As another preferable aspect, in any aspect of the variable displacement pump, the pump accommodating portion has a pivot portion provided so as to be adjacent to the first low pressure chamber in a rotation direction of the pump structure and a second low pressure chamber provided at an opposite side to the first low pressure chamber with respect to the pivot portion, and the main gallery pressure is also introduced into the second low pressure chamber.

Further, as another variable displacement pump based on the embodiments described above, for instance, the following aspects can be raised.

As one aspect of the present invention, a variable displacement pump comprises: a pump housing having a pump accommodating portion, a suction portion and a discharge portion, each of which is open at the pump accommodating portion; an adjustment ring movably provided in the pump accommodating portion; a pump structure provided inside the adjustment ring and discharging oil, which is sucked from the suction portion, from the discharge portion by being driven and rotated, wherein a flow amount of the oil discharged from the discharge portion by the pump structure is changed when the adjustment ring moves; a control hydraulic chamber provided between the pump accommodating portion and the adjustment ring in a radial direction of the pump structure with respect to a rotation axis of the pump structure and forcing the adjustment ring in a direction in which the flow amount of the oil discharged from the discharge portion decreases when a control pressure is introduced into the control hydraulic chamber; a control valve controlling pressure of oil in the control hydraulic chamber; and a first pressure chamber provided at a position that overlaps with the discharge portion between the pump accommodating portion and the adjustment ring in the radial direction of the pump structure with respect to the rotation axis of the pump structure, wherein a discharge pressure is introduced into the first pressure chamber.

As another preferable aspect of the variable displacement pump, the pump accommodating portion has a second pressure chamber provided at an opposite side to the first pressure chamber with respect to a pivot portion, and the discharge pressure is also introduced into the second pressure chamber.

Moreover, as another variable displacement pump based on the embodiments described above, for instance, the following aspects can be raised.

As one aspect of the present invention, a variable displacement pump comprises: a pump housing having a pump accommodating portion, a suction portion and a discharge portion, each of which is open at the pump accommodating portion; an adjustment ring movably provided in the pump accommodating portion; a pump structure provided inside the adjustment ring and discharging oil, which is sucked from the suction portion, from the discharge portion by being driven and rotated, wherein a flow amount of the oil discharged from the discharge portion by the pump structure is changed when the adjustment ring moves; a control hydraulic chamber provided between the pump accommodating portion and the adjustment ring in a radial direction of the pump structure with respect to a rotation axis of the pump structure and forcing the adjustment ring in a direction in which the flow amount of the oil discharged from the discharge portion decreases when a control pressure is introduced into the control hydraulic chamber; a control valve controlling pressure of oil in the control hydraulic chamber; and a groove portion provided between a side surface, in a direction of the rotation axis of the pump structure, of the adjustment ring and the pump accommodating portion between the discharge portion and the control hydraulic chamber in the radial direction of the pump structure with respect to the rotation axis of the pump structure, wherein pressure that is equal to or less than a hydraulic pressure of the oil discharged from the discharge portion is guided to the groove portion.

As another preferable aspect of the variable displacement pump, the groove portion communicates with the suction portion.

As another preferable aspect, in any aspect of the variable displacement pump, the groove portion is provided along a rotation direction of the pump structure, and communicates with pump chambers facing the suction portion.

As another preferable aspect, in any aspect of the variable displacement pump, a low pressure portion has atmospheric pressure, and the groove portion communicates with the low pressure portion through a hole portion provided at the groove portion and an inside of the pump housing.

The invention claimed is:

1. A variable displacement pump comprising:

a pump housing having a pump accommodating portion, a suction portion and a discharge portion wherein the suction portion and the discharge portion are open at the pump accommodating portion;

an adjustment ring movably provided in the pump accommodating portion;

a pump structure provided inside the adjustment ring and discharging oil, which is sucked from the suction portion, from the discharge portion by being driven and rotated, wherein a flow amount of the oil discharged from the discharge portion by the pump structure is changed when the adjustment ring moves;

a control hydraulic chamber provided between the pump accommodating portion and the adjustment ring in a radial direction of the pump structure with respect to a rotation axis of the pump structure and forcing the adjustment ring in a direction in which the flow amount of the oil discharged from the discharge portion decreases when a control pressure is introduced into the control hydraulic chamber;

a control valve controlling pressure of oil in the control hydraulic chamber; and a first low pressure chamber provided at a position that overlaps with the discharge portion between the pump accommodating portion and the adjustment ring in the radial direction of the pump structure with respect to the rotation axis of the pump structure and always communicating with an oil pan having atmospheric pressure that is equal to or less than a hydraulic pressure of the oil discharged from the discharge portion, wherein the first low pressure chamber is provided with a drain hole that directly communicates with the oil pan, and wherein the first low pressure chamber is configured such that the atmospheric pressure of the oil pan is introduced into the first low pressure chamber through the drain hole, and the oil discharged from the discharge portion flows into, through a gap between the adjustment ring and the pump housing, the first low pressure chamber by a pressure difference between the discharge portion and the low pressure chamber, and the oil flowing into the first low pressure chamber is drained to the oil pan through the drain hole.

2. The variable displacement pump as claimed in claim 1, wherein:

the pump accommodating portion has a pivot portion provided so as to be adjacent to the first low pressure chamber in a rotation direction of the pump structure, and the adjustment ring pivots on the pivot portion.

* * * * *